US011634901B2

(12) United States Patent
Garofalo et al.

(10) Patent No.: US 11,634,901 B2
(45) Date of Patent: Apr. 25, 2023

(54) APPARATUS FOR MAKING A GEODESIC SHAPE AND METHODS OF USING THE SAME

(71) Applicants: James C. Garofalo, Hadley, NY (US); Robert L. Keller, Corinth, NY (US)

(72) Inventors: James C. Garofalo, Hadley, NY (US); Robert L. Keller, Corinth, NY (US)

(73) Assignee: Geodesic Earthworks, LLC, Saratoga, NY (US)

( * ) Notice: Subject to any disclaimer, the term of this patent is extended or adjusted under 35 U.S.C. 154(b) by 0 days.

(21) Appl. No.: 15/981,890

(22) Filed: May 16, 2018

(65) Prior Publication Data

US 2018/0334796 A1 Nov. 22, 2018

Related U.S. Application Data

(60) Provisional application No. 62/507,322, filed on May 17, 2017.

(51) Int. Cl.
*E04B 1/32* (2006.01)
*E04B 2/78* (2006.01)

(52) U.S. Cl.
CPC ..... *E04B 1/3211* (2013.01); *E04B 2/789* (2013.01); *E04B 2001/3241* (2013.01); *E04B 2001/3276* (2013.01); *E04B 2001/3294* (2013.01)

(58) Field of Classification Search
CPC ..... E04B 1/3211; E04B 1/32; E04B 1/34357; E04B 1/34384; E04B 1/344; E04B 2001/327; E04B 2001/3276; E04B 2001/3294; E04B 2001/3288; E04C 2/40; E04C 2/405
See application file for complete search history.

(56) References Cited

U.S. PATENT DOCUMENTS 3,207,320 A 9/1965 Nichols
3,343,324 A * 9/1967 Gordon ..... E02D 29/06 52/584.1
4,012,872 A * 3/1977 Stolpin ..... E04B 1/3211 52/81.3

(Continued)

FOREIGN PATENT DOCUMENTS

EP 1957723 B1 6/2013

*Primary Examiner* — Ryan D Kwiecinski
(74) *Attorney, Agent, or Firm* — GFD Patents, LLC; Gerald F. Dudding

(57) ABSTRACT

A method of making a geodesic shape is provided. The method comprises of providing and assembling a plurality of pre-made forms, and a plurality of struts. The pre-made forms have a triangular shape, first and second inner edges, and an outer edge. The length of each inner edge and outer edge are determined by the frequency of the geodesic shape, diameter of the geodesic shape, and known formulas for relating diameter and frequency when creating a geodesic dome or sphere. Using the pre-made forms and struts, a polygonal shape is assembled, each shape having either five or six pre-made forms. The resulting desired polygonal shape and additional desired polygonal shapes made using the same steps are connected at preset angles in known geodesic form and function. The desired polygonal shapes then combine to form a desired geodesic shape. Throughout the process, no struts are operably coupled to other struts.

15 Claims, 24 Drawing Sheets

(56) References Cited

U.S. PATENT DOCUMENTS 4,094,110 A * 6/1978 Dickens ..... E04B 1/3505 52/444
4,262,461 A * 4/1981 Johnson ..... E04B 1/3211 403/252
4,611,441 A * 9/1986 Wickens ..... E04B 1/3211 52/81.4
4,729,197 A * 3/1988 Miller ..... E04B 1/3211 52/81.3
5,452,555 A * 9/1995 Lee ..... E04C 2/384 52/584.1
5,560,151 A * 10/1996 Roberts ..... E04B 1/3211 52/249
5,732,514 A * 3/1998 Organ ..... E04B 1/3211 52/80.1
6,098,347 A * 8/2000 Jaeger ..... E04B 1/3211 52/81.3
8,820,006 B2 9/2014 Zook
8,863,447 B2 10/2014 Bischoff
8,973,532 B2 3/2015 Fredricks
9,103,110 B1 * 8/2015 Gerber ..... E04C 2/38
9,151,306 B2 10/2015 Sun
9,452,636 B2 * 9/2016 Russo ..... B44D 3/185
10,415,231 B1 * 9/2019 Pramov ..... E04B 1/3211
2002/0088185 A1 * 7/2002 Miller ..... E04B 1/3211 52/81.4
2003/0213186 A1 * 11/2003 Geiger ..... E04B 7/102 52/81.3
2007/0163185 A1 * 7/2007 Morley ..... E04B 1/3205 52/81.1
2008/0066393 A1 * 3/2008 Sorensen ..... E04B 1/3211 52/81.1
2015/0000223 A1 * 1/2015 Burger ..... E04C 3/40 52/653.1
2016/0258152 A1 * 9/2016 Bierschenk ..... C04B 28/34
2019/0382998 A1 * 12/2019 Rim ..... E04B 1/40

* cited by examiner

APPARATUS FOR MAKING A GEODESIC SHAPE AND METHODS OF USING THE SAME

1. FIELD OF THE INVENTION

The present invention relates generally to the assembly of a Geodesic Dome such that the Geodesic form may be arrived at spontaneously, having achieved the multitude of precise axial and dihedral angles through the use of strategically placed hinges.

2. BACKGROUND

Geodesic domes and other geodesic shapes are used in construction as efficient, fast, structurally sound designs. However, a common problem with many methods of assembling geodesic shapes is the need to achieve correct radial, dihedral and axial angels in construction and assemble of the components. Therefore, there is a need for a method of making a geodesic shape out of pre-made forms and struts through the use of hinges attaching struts to their respective panels.

SUMMARY OF THE INVENTION

A first aspect of the present invention provides a method of making a geodesic shape. The method comprises of providing and assembling a plurality of pre-made forms, and a plurality of struts. The pre-made forms have a triangular shape, first and second inner edges, an inner face and an outer face and an outer edge. The length of each inner edge and outer edge are determined by the frequency of the geodesic shape, diameter of the geodesic shape, using known formulas for relating diameter and frequency when creating a geodesic dome or sphere. Using the pre-made forms and struts, a polygonal shape is assembled in several steps. The first step comprises operably coupling a first pre-made form, along its uncoupled first inner edge to a first face of a first strut, by a first hinge(s). The second step comprises operably coupling a second of the pre-made form, along its uncoupled second inner edge to a second face of the first strut, by a second hinge(s). The third step comprises operably coupling the second pre-made form, along its uncoupled first inner edge to a first face of a second strut, by a its first hinge(s). The fourth step comprises sequentially operably coupling inner edges of additional pre-made forms to respective faces of struts already in the structure and sequentially operably coupling additional struts to the additional pre-made forms in the structure with uncoupled inner edges, resulting in a structure in which the inner edges of the first and last pre-made forms have not been coupled to respective faces of the last additional strut. The fifth step comprises forming the desired polygonal shape by operably coupling the inner edge of a last coupled pre-made form and a second inner edge of the first premade form to respective faces of the last additional strut, creating desired dihedral angles between the inner edges of the pre-made forms, and creating a desired axial angles between a z axis of the desired polygonal shape and the inner face of each premade form. The total number of pre-made forms in the polygonal shape is either four five or six. In addition to polygonal shapes there are also polygonalpatch(es). There is a method for assembling a polygonal patch. The first step of the method involves operably coupling a seventh pre-made form, along its uncoupled first inner edge to a first face of a seventh strut, by a first hinge(s). A second step involves operably coupling an eighth pre-made form, along its uncoupled second inner edge to a second face of the seventh strut, by a second hinge(s). A third step involves operably coupling the eighth pre-made form, along its uncoupled first inner edge to a first face of an eighth strut, by its first hinge(s). A fourth step involves operably coupling a ninth pre-made form, along its uncoupled second inner edge to a second face of the eighth strut, by its second hinge(s). There is a method for assembling a geodesic shape. The method involves coupling desired polygonal shapes made using the aforementioned steps to desired polygonal shapes, premade forms and to polygonal patches made using the aforementioned steps by coupling their outer edges, so that the desired polygonal shapes, polygonal patches and additional pre-made forms create a geodesic shape. Throughout the entire method, no struts are operably coupled to other struts. Throughout the entire method, the free range of motion of each strut-panel interface of each panel along its axis aligns itself into the ideal axial and dihedral angles for the desired geodesic shape spontaneously as the assembly progresses, without any additional measurement or cutting by the user.

A second aspect of the present invention provides an apparatus for making a polygonal shape. The apparatus is comprised of five or six struts each with a first face operably coupled to a first hinge(s) and second face operably coupled a second hinge(s), and five or six pre-made forms which are triangular in shape, with first and second inner edges, an inner face and an outer face, and an outer edge. The lengths of each inner edges and the outer edge of the pre-made form are determined by the frequency of the geodesic shape, diameter of the geodesic shape, and known formulas for relating diameter and frequency to create a geodesic dome. A first pre-made form is operably coupled along its first inner edge to the first face of a first strut by first hinge(s). A second pre-made form is operably coupled along its second inner edge to a second face of the first strut, its second hinge(s). The second pre-made form is then operably coupled along its first inner edge to a first face of a second strut, by its first hinge(s). A third pre-made form is then operably coupled along its second inner edge to the second face of the second strut by its second hinge(s). The third pre-made form is operably coupled along its first inner edge to a first face of a third strut, by its first hinge(s). A fourth pre-made form is operably coupled along its second inner edge to a second face of the third strut, by its second hinge(s). The fourth pre-made form is operably coupled along its first inner edge to a first face of the fourth strut, by its first hinge(s). A fifth pre-made form may be operably coupled along its second inner edge to a second face of the fourth strut, by its second hinge(s) if there is a sixth pre-made form. The fifth pre-made form may be operably coupled along its first inner edge to a first face of the fifth strut, by its first hinge(s) if there is a sixth strut. A desired polygonal shape is formed by operably coupling the inner edge of a final pre-made form and a second inner edge of the first premade form to respective faces of the last additional strut, creating desired dihedral angles between the inner edges of the pre-made forms, and creating a desired axial angles between a z axis of the desired polygonal shape and the inner face of each premade form. Throughout creation of the desired polygonal shape, no struts are operably coupled to other struts. The free range of motion of each strut-panel interface of each panel along its axis aligns itself into the ideal axial and dihedral angles for the desired geodesic shape spontaneously as the assembly progresses, without any additional measurement or cutting by the user.

A third aspect of the present invention provides a method of making a geodesic shape. The method includes a plurality of triangular pre-made forms having a triangular shape, first and a second inner edges, and an outer edge. The length of each inner edge and outer edge are determined by the frequency of the geodesic shape, diameter of the geodesic shape, and known formulas for relating diameter and frequency when creating a geodesic dome or sphere. The method includes steps for assembling a polygonal shape. The first step involves operably coupling a first pre-made form, along its uncoupled first inner edge to the first face of a first partial strut, by its first hinge(s). The second step involves sequentially operably coupling inner edges of the first pre-made form to respective faces of partial struts. The third step involves operably coupling a second pre-made form, along its uncoupled inner edges to respective faces of partial struts. The fourth step involves operably coupling the first partial strut of the first pre-made form to the first partial strut of the second pre-made form in a fixed interface forming a complete strut, thus allowing a free range of motion of each strut-panel interface of each panel along its axis. The fifth step involves sequentially operably coupling partial struts operably coupled to inner edges of additional pre-made forms to respective partial struts already in the structure and sequentially operably coupling additional partial struts to the additional pre-made forms in the structure with uncoupled inner edges, resulting in a structure in which the inner edges of the first and last pre-made forms have not been coupled. The desired polygonal shape is formed by operably coupling a partial strut operably coupled to an inner edge of a last coupled pre-made form and a partial strut operably coupled to a second inner edge of the first premade form in a fixed interface forming a complete strut, creating desired dihedral angles between the inner edges of the pre-made forms, and creating desired axial angles between a z axis of the desired polygonal shape and the inner face of each premade form. The total number of pre-made forms in the polygonal shape is either five or six. The method includes steps for assembling a polygonal patch. The first step involves operably coupling a seventh pre-made form, along its uncoupled first inner edge to a first face of a seventh strut, by a first hinge(s). The second step involves operably coupling an eighth pre-made form, along its uncoupled second inner edge to a first face of an eighth strut, by a second hinge(s). The third step involves operably coupling the seventh strut and the eighth strut. The fourth step involves operably coupling the eighth pre-made form, along its uncoupled first inner edge to a first face of a ninth strut, by its first hinge(s). The fifth step involves operably coupling a ninth pre-made form, along its uncoupled second inner edge to a first face of a tenth strut, The sixth strut includes operably coupling the ninth strut and the tenth strut. The method includes steps for assembling a geodesic shape. The first step includes coupling desired polygonal shapes made using the previously described steps to desired polygonal shapes, premade forms, and to polygonal patches made using the previously described steps by coupling their outer edges at preset angles in known geodesic form and function, so that the desired polygonal shapes, polygonal patches, and additional pre-made forms create a geodesic shape. The free range of motion of each strut-panel interface of each panel along its axis aligns itself into the ideal axial and dihedral angles for the desired geodesic shape spontaneously as the assembly progresses, without any additional measurement or cutting by the user. Throughout the entire process, no complete struts are operably coupled to other complete struts.

A fourth aspect of the present invention provides method of making a polygonal shape from a pre-made form. The polygonal shape is characterized by having correct dihedral and axial angles for use in constructing a geometric shape. The method provides a plurality of triangular pre-made forms, each pre-made form having a triangular shape, first and second inner edges, an outer edge, and an inner face and an outer face. A length of each inner edge and outer edge are determined by the frequency of the geodesic shape, and diameter of the geodesic shape. The method then comprises assembling the polygonal shape, where the total number of pre-made forms in the polygonal shape is either five or six. There are steps to assembling the polygonal shape. The first step involves operably coupling a first pre-made form, along its uncoupled first inner edge to a first face of a first strut, by a first hinge(s). The second step involves operably coupling a second pre-made form, along its uncoupled second inner edge to a second face of the first strut, by a second hinge(s). The third step involves operably coupling the second pre-made form, along its uncoupled first inner edge to a first face of a second strut, by its first hinge(s). The fourth step involves forming a planar precursor to the desired polygonal shape by sequentially operably coupling inner edges of additional pre-made forms to respective faces of struts already in the structure and sequentially operably coupling additional struts to the additional pre-made forms in the structure with uncoupled inner edges, resulting in a structure in which the inner edges of the first and last pre-made forms have not been coupled to respective faces of the last additional strut. The fifth step involves forming the desired polygonal shape by raising the planar precursor and operably coupling the inner edge of a last coupled pre-made form and a second inner edge of the first premade form to respective faces of the last additional strut, resulting in creating correct dihedral angles which are between the inner faces of the premade forms and faces of the coupled struts, and the correct axial angles which are between a z axis of the desired polygonal shape and the inner face of each premade form without any additional measurement. Throughout the entirety of the assembly, no struts are operably coupled to other struts.

BRIEF DESCRIPTION OF THE FIGURES

The features of the invention are set forth in the appended claims. The invention itself, however, will be best understood by reference to the following detailed description of an illustrative embodiment when read in conjunction with the accompanying drawings, wherein:

DETAILED DESCRIPTION OF THE EMBODIMENTS

Definitions

Figure 1A:
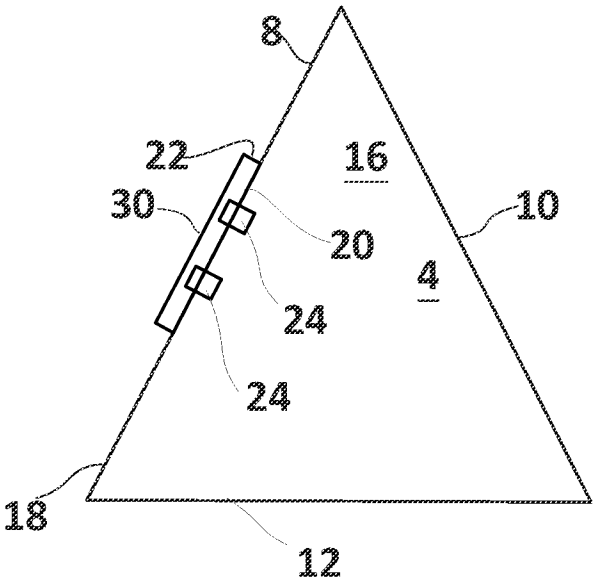
FIG. 1A depicts a plan view of a pre-made form 4, in accordance with embodiments of the present invention.

Hereinafter, unless defined otherwise, the term "pre-made form" is defined as a planar triangular shape having first and second inner edges 8, 10, an inner face 11 and an outer face 13 and an outer edge 12, depicted in FIG. 1A.

Hereinafter, unless defined otherwise, the term "polygonal shape" is defined as comprising five or six struts 6 each with a first face operably coupled to a first hinge(s) and second face operably coupled a second hinge(s), and five or six pre-made forms, e.g. 14 in FIG. 1E.

Hereinafter, unless defined otherwise, the term "geodesic" is the shortest distance between two points on a sphere.

Hereinafter, unless defined otherwise, the term "geodesic shape" is defined as comprising a plurality of polygonal shapes 14 and plurality of polygonal patches 222, depicted in FIGS. 3A-C.

One objective of the present invention is to provide a method of constructing geodesic domes by using pre-made forms and struts with hinges that are constructed at pre-measured intervals. This allows for easy assembly of a geodesic dome without time and cost-intensive measuring and fitting on site.

With this invention, a full concrete dome can be assembled in a day and a half onsite without recutting or otherwise customizing the struts or the pre-made forms. In particular, ensuring that the struts do not operably couple to other struts and making the pre-made forms the load-bearing sections of the geodesic dome ensures that the struts do not have to be re-measured or recut to fit into place, saving considerable time and the use of additional equipment onsite.

A second objective of the present invention is to provide a methodology allowing for ease of construction of a Geodesic Dome strut-panel system regardless of dome frequency or diameter by achieving the correct axial and dihedral angles associated with geodesic dome construction automatically, effortlessly and as the proximal result of the use of a hinge(s) attaching a strut (be it a 2×4, 6, 8 etc.) lengthwise to each of the three panel edges of each panel, thence attaching struts of like length together from adjacent panels thus allowing a free range of motion of each strut-panel interface of each panel along the panel-edge axis. The strut-to-strut assembly of adjacent panels is necessarily a fixed interface. The motion allowed each strut/panel interface can therefore accommodate differing dihedral angles, one side of the strut-strut interface to the other.

The hinges of the present invention allow for freedom of motion along the interface of each strut and panel, allowing each to accommodate differing dihedral angles. This allows the axial and dihedral angles to be arrived at passively, as an inherent result of the invention's assembly. As the dome is constructed with this invention, the construction will increasingly and effortlessly approximate a sphere as assembly moves towards completion. The invention spontaneously arrives passively at the correct axial and dihedral angles and the strength of the structure increases dramatically as the assembly progresses.

When these dihedral angles are combined with the accompanying axial angles, normally combining the panels into the right angles at the right time during construction is challenging, requiring several measurements and occasional adjusting or cutting. The present invention avoids this difficulty.

As the dome is constructed using this invention, by a singular panel at a time or pre-assembled into groups of pentagons, hexagons or otherwise groupings, construction will increasingly and effortlessly approximate a sphere as the assembly moves toward completion. The present invention spontaneously arrives passively at the correct axial and dihedral angles and the strength of the structure increases dramatically as the assembly progresses.

This result of correct axial and dihedral angles are arrived at by simply allowing freedom of movement along the panel-to-adjacent-strut interface. The interface is not fixed, and uses a hinge to allow movement in the plane of the hinge. Every panel has three struts running along its edges attached by a hinge or series of hinges that allow motion only in the hinge plane.

Simultaneously, the strut-to-strut interface is rigidly fixed, i.e. it is bolted or clamped to the strut of an adjacent panel. In this way, each panel edge with its attached-by-hinge strut is free to approximate the true/ideal axial and dihedral angles that the dome spontaneously approximates as the assembly progresses. This result is achieved without axial or dihedral calculation or component fabrication (other than cutting panels to correct sizes) to achieve the desired result. It is arrived at passively.

A one-eighth polpolmodel was built in an attempt to prove this concept. At no time were the dihedral or axial angles measured in the assembly process. As was claimed above, the construction/assembly process achieved this result for these angles spontaneously and as a consequence of the hinged strut/panel; i.e. by simply rigidly fixing adjacent struts of different panels while flexibly connecting struts to their respective panels in the plane of the hinge joint that allowed for that freedom of movement in that plane.

What is unique about this approach to constructing Geodesic Domes is that if the 'strut-panel' interface is allowed to remain flexible along the hinge/strut plane, the proper dome 'geometry', i.e. the array of dihedral and axial angles can be arrived at passively. The dome will simply "find" the proper angles as a function of some conservation of stress and energy law of nature that it enjoys. Only one thing is necessary from a material fabrication standpoint: Exact panel lengths. Exact panel lengths achieves the correct 'radial' angles such that when the pentagons and hexagons are constructed, 'closing' the last strut-strut interface 'forces' the dome geometry from 2-d to 3-d; the hinged panel/strut angle is brought out at each panel edge across the entire pentagon or hexagon. At no time then are we nailing or screwing panels to struts or panels to panels.

Initial research in constructing this model showed important considerations. When constructing at this scale, the selection of materials became increasingly flimsy: The 150 panels used were made of a 220" plywood, and the struts of a very flexible PVC trim product. The strut-strut interfaces were held together with 4" cable ties. The hinge ended-up being a very tough ordnance tape as even the smallest hinges seemed immensely impractical for the sheer numbers involved (2 hinges per strut, 3 struts per panel, 160 panels per dome, for a total of 960 hinges installed). When the dome was 'closed', the flexibility of these components failed to 'force the geometry', i.e. it failed to cause the flat, 2-d pentagons/hexagons into 3-d dome geometry. The eventual working solution involved securing the panel/panel interface with cable ties at the end of the panels to maintain the dome geometry. This research showed that the hinge to be used must be rigid in every sense other than the desired direction of motion.

A first aspect of the present invention provides a method of making a geodesic shape 2. The method comprises of providing and assembling a plurality of pre-made forms 4, and a plurality of struts 6, as shown in FIG. 1A-F. The pre-made forms have a triangular shape, first and second inner edges 8, 10, an inner face 11 and an outer face 13 and an outer edge 12. The length of each inner edge 8, 10 and outer edge 12 are determined by the frequency of the desired geodesic shape, diameter of the desired geodesic shape, and known formulas for relating diameter and frequency when creating a geodesic dome or sphere.

Figure 3A:
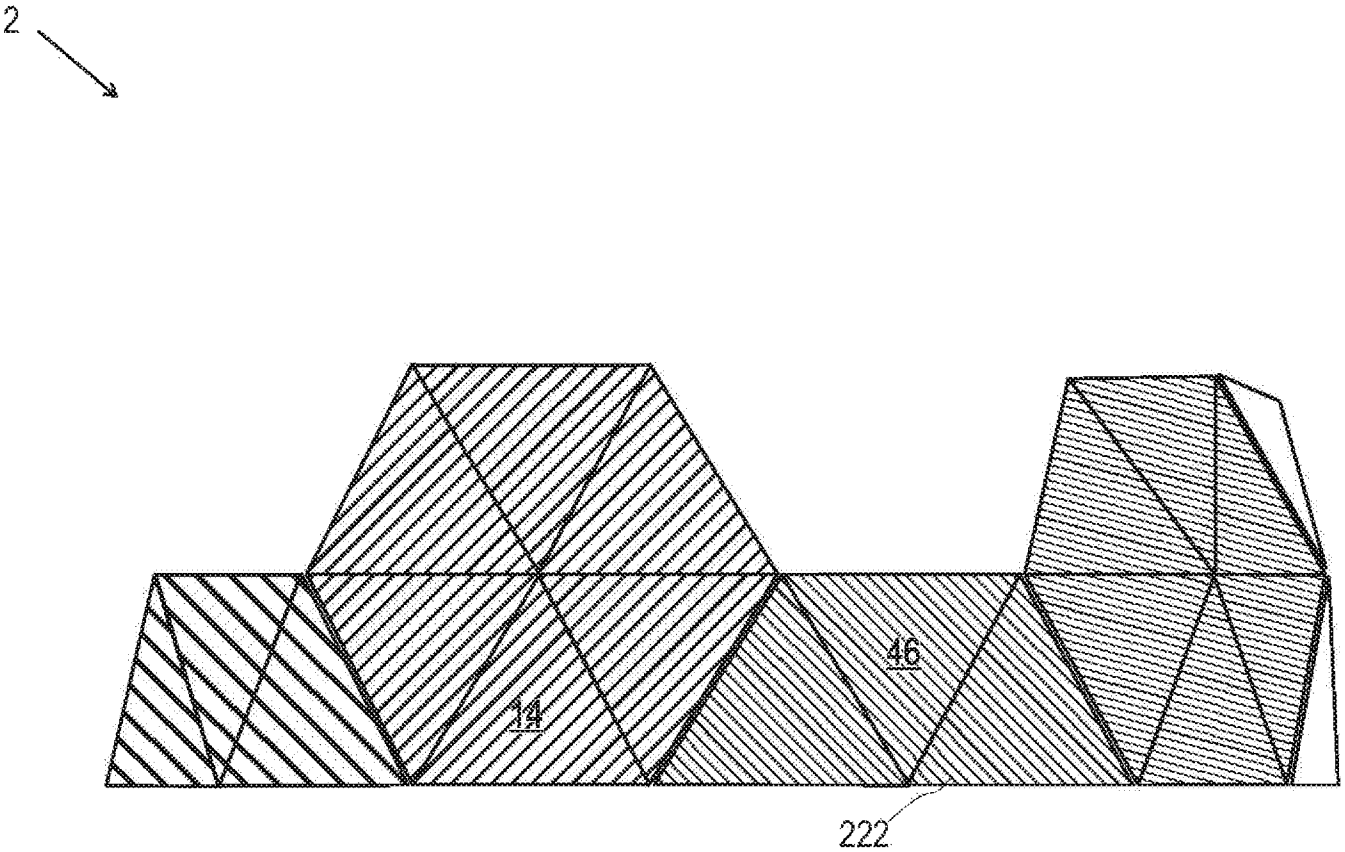
FIGS. 3A-C depicts side elevation views of stages of construction of a geodesic shape, in accordance with embodiments of the present invention.
Figure 3B:
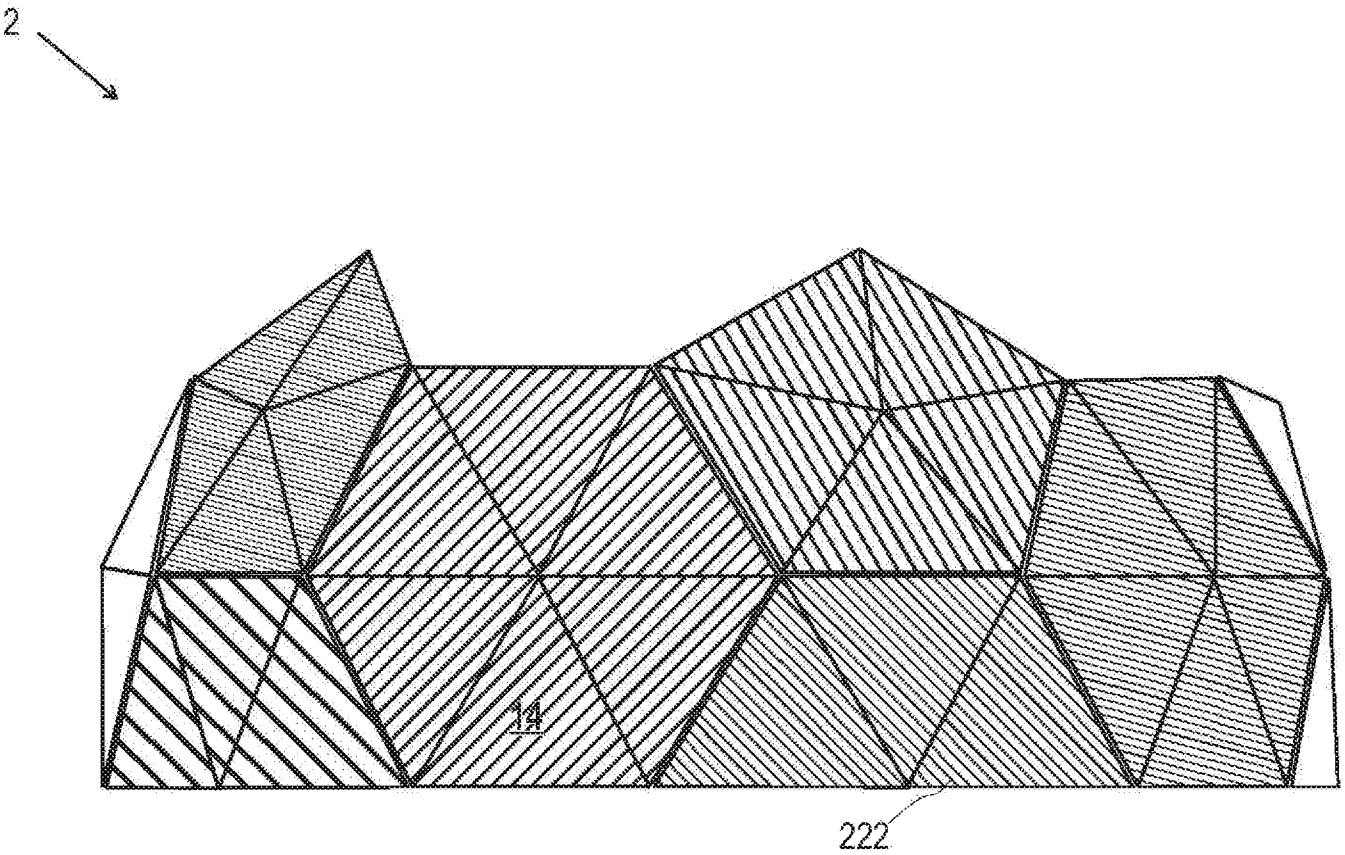
Figure 3C:
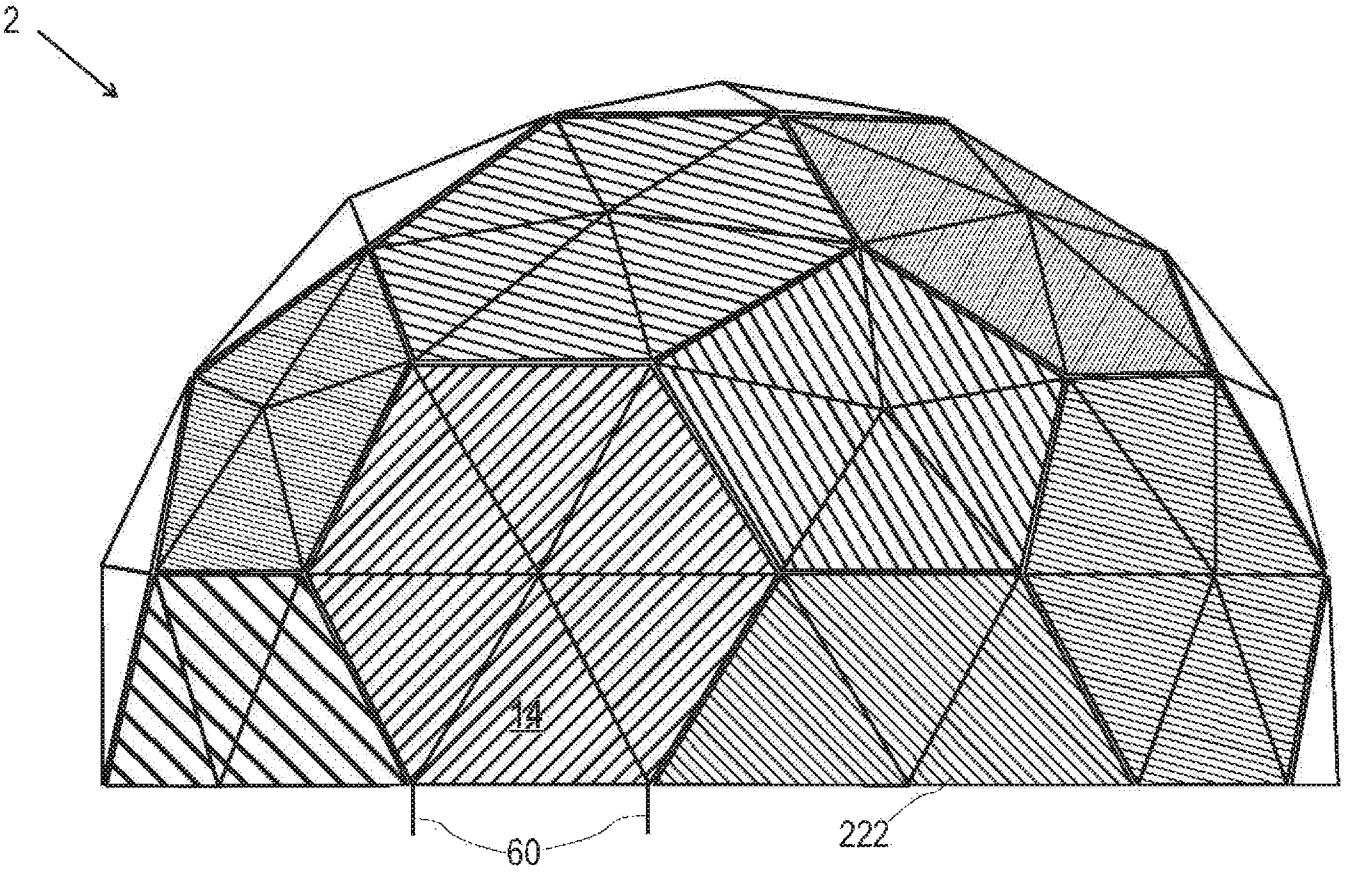

FIGS. 3A-C depict side elevation views of stages of construction of a geodesic shape 2 from a plurality of polygonal shapes 14 and plurality of polygonal patches 222. The geodesic shape 2 may be a geodesic dome or sphere. FIG. 3A depicts a possible first stage 1 in the construction of the geodesic shape 2. FIG. 3B depicts a possible intermediate stage 3 after the possible first stage 1 in the construction of the geodesic shape 2 shown in FIG. 3A. FIG. 3C depicts a completed geodesic shape 2. The geodesic shape 2 comprises a plurality of polygonal shapes 14 and plurality of polygonal patches 222. The plurality of polygonal shapes 14 and plurality of polygonal patches 222 are made from pre-made forms 4, and a plurality of struts 6, as shown in FIGS. 1A-F.

FIG. 1A depicts a plan view of the pre-made forms 4, having a triangular shape, first and second inner edges 8, 10, an inner face 11 and an outer face 13 and an outer edge 12. A length of each inner edge 8, 10 and outer edge 12 are determined by the frequency of the desired geodesic shape 2, diameter of the desired geodesic shape 2, and known formulas for relating diameter and frequency when creating a geodesic dome or sphere. A desired polygonal shape 14 is assembled using the pre-made forms 4 and struts 6. A first pre-made form 16 is operably coupled along its uncoupled first inner edge 18 to a first face 20 of a first strut 22, by a first hinge(s) 24.

Figure 1B:
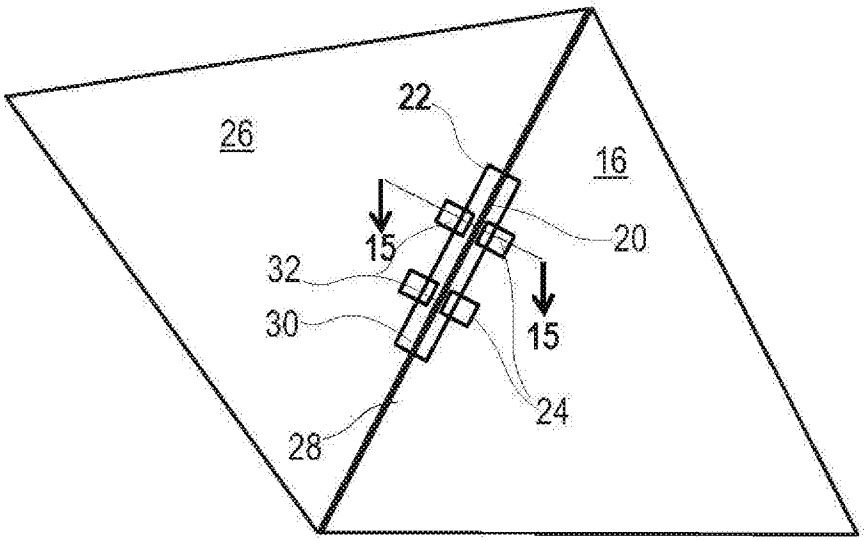
FIG. 1B depicts a plan view of FIG. 1A after a second pre-made form is operably coupled along its uncoupled second inner edge to a second face of the first strut, by a second hinge(s), in accordance with embodiments of the present invention.

FIG. 1B depicts a plan view of FIG. 1A after a second 26 pre-made form 4 is operably coupled along its uncoupled second inner edge 28 to a second face 30 of the first strut 22, by a second hinge(s) 32.

Figure 1C:
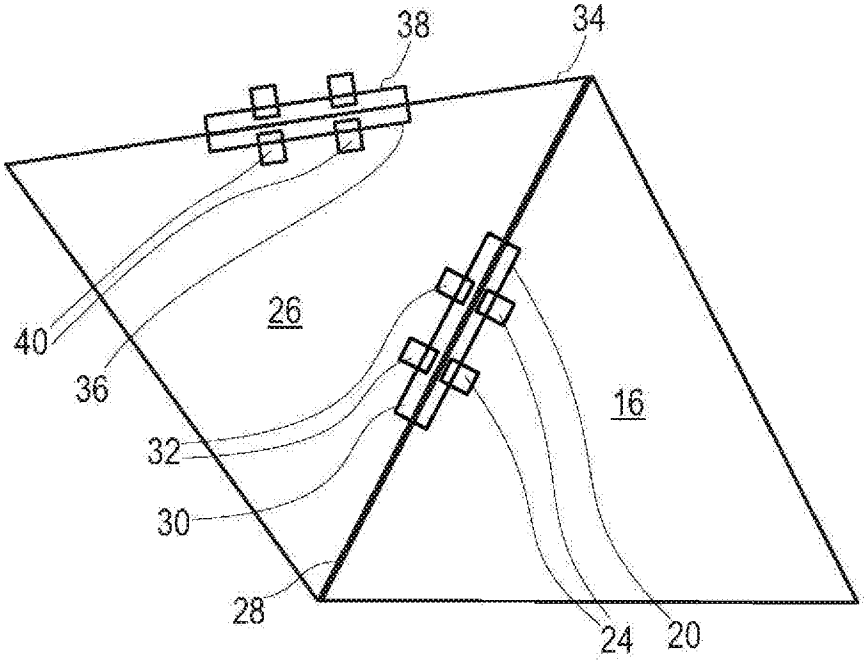
FIG. 1C depicts a plan view of FIG. 1B after the second pre-made form is operably coupled along its uncoupled first inner edge to a first face of a second strut, by its first hinge(s), in accordance with embodiments of the present invention.

FIG. 1C depicts a plan view of FIG. 1B after the second pre-made form 26 is operably coupled along its uncoupled first inner edge 34 to a first face 36 of a second strut 38, by its first hinge(s) 40.

Figure 1D:
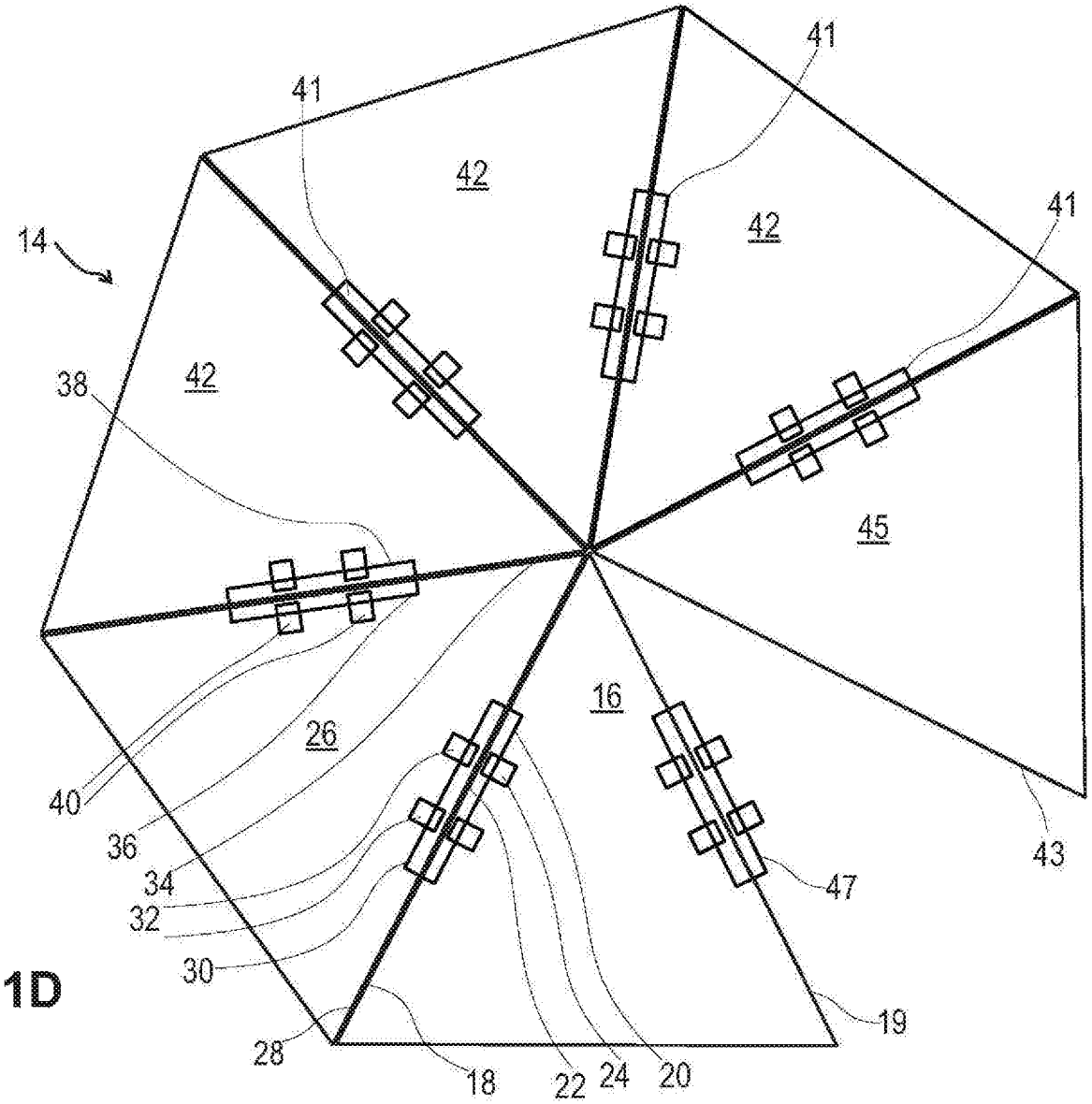
FIG. 1D depicts a plan view of FIG. 1C after additional pre-made forms have been operably coupled to respective faces of struts already in the structure and additional struts have been operably coupled to the additional pre-made forms in the structure with uncoupled inner edges, in accordance with embodiments of the present invention.

FIG. 1D depicts a plan view of FIG. 1C after additional pre-made forms 4 have been operably coupled to respective faces of struts already in the structure and additional struts 41 have been operably coupled to the additional pre-made forms 42 in the structure with uncoupled inner edges. This results in a structure in which the inner edges of the first and last pre-made forms have not been coupled to respective faces of the last additional strut 47.

Figure 1E:
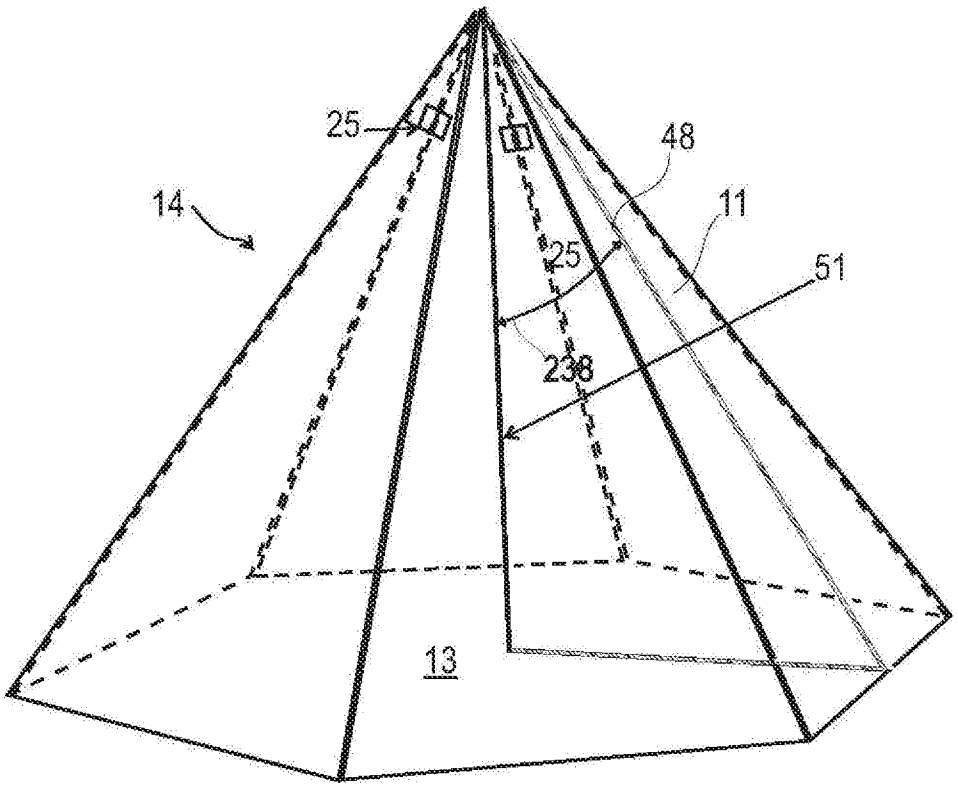
FIG. 1E depicts a front view of a hexagonal polygonal shape, in accordance with embodiments of the present invention.

FIG. 1E depicts a plan view of FIG. 1D after operably coupling the inner edge of a last coupled pre-made form and a second inner edge 19 of the first premade form to respective faces of the last additional strut, creating a desired dihedral angles $\theta_1$, $\theta_2$ between the inner edges of the pre-made forms, and creating a desired axial angles $\theta_3$ between a z axis of the desired polygonal shape and the inner face of each premade form, thus forming the desired polygonal shape 14. The dihedral angles $\theta_1$, $\theta_2$ may advantageously be the same or different. FIG. 1E also shows the Z axis 51 of the desired polygonal shape 14, which is a line going through the center of the desired polygonal shape 14. The axial angle $\theta_3$ is between the Z axis 51 and the inside face 11 of each of the premade forms.

Figure 1F:
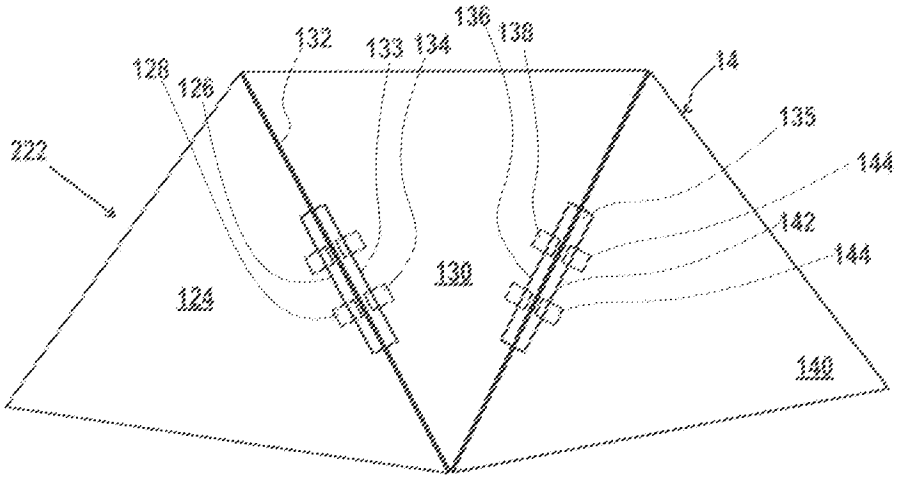
FIG. 1F depicts a plan view of a polygonal patch, in accordance with embodiments of the present invention.

FIG. 1F depicts a plan view of a polygonal patch 222. The polygonal patch 222 is formed by operably coupling a seventh pre-made form 124, along its uncoupled first inner edge to a first face of a seventh strut 126, by a first hinge(s) 128, operably coupling an eighth pre-made form 130, along its uncoupled second inner edge to a second face 133 of the seventh strut 126, by a second hinge(s), operably coupling the eighth pre-made form, along its uncoupled first inner edge 132 to a first face 136 of a eighth strut 135, by its first hinge(s) 138, and operably coupling a ninth pre-made form 140, along its uncoupled second inner edge to a second face 142 of the eighth strut 134, by its second hinge(s) 144.

Figure 2B:
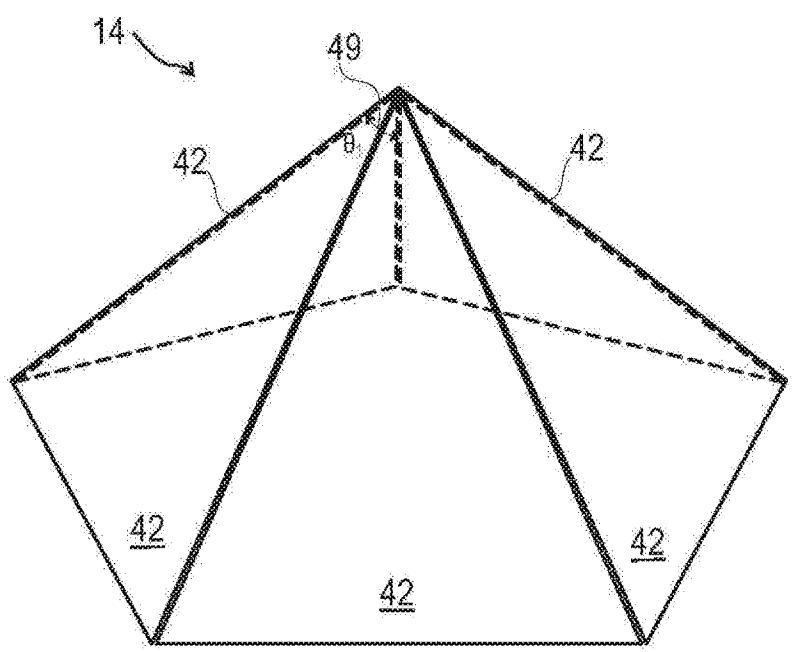
FIG. 2A-B depict front views of a pentagonal polygonal shape, in accordance with embodiments of the present invention.
Figure 2A:
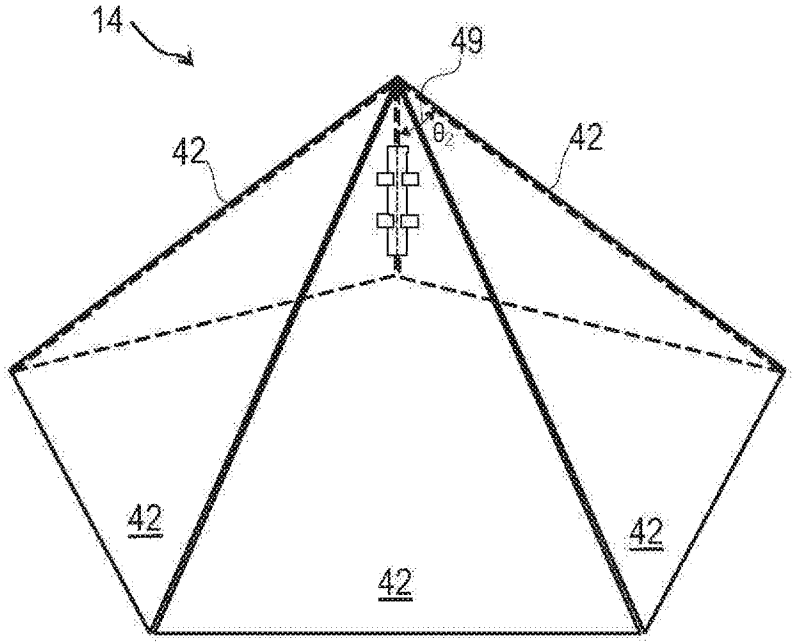
Figure 9:
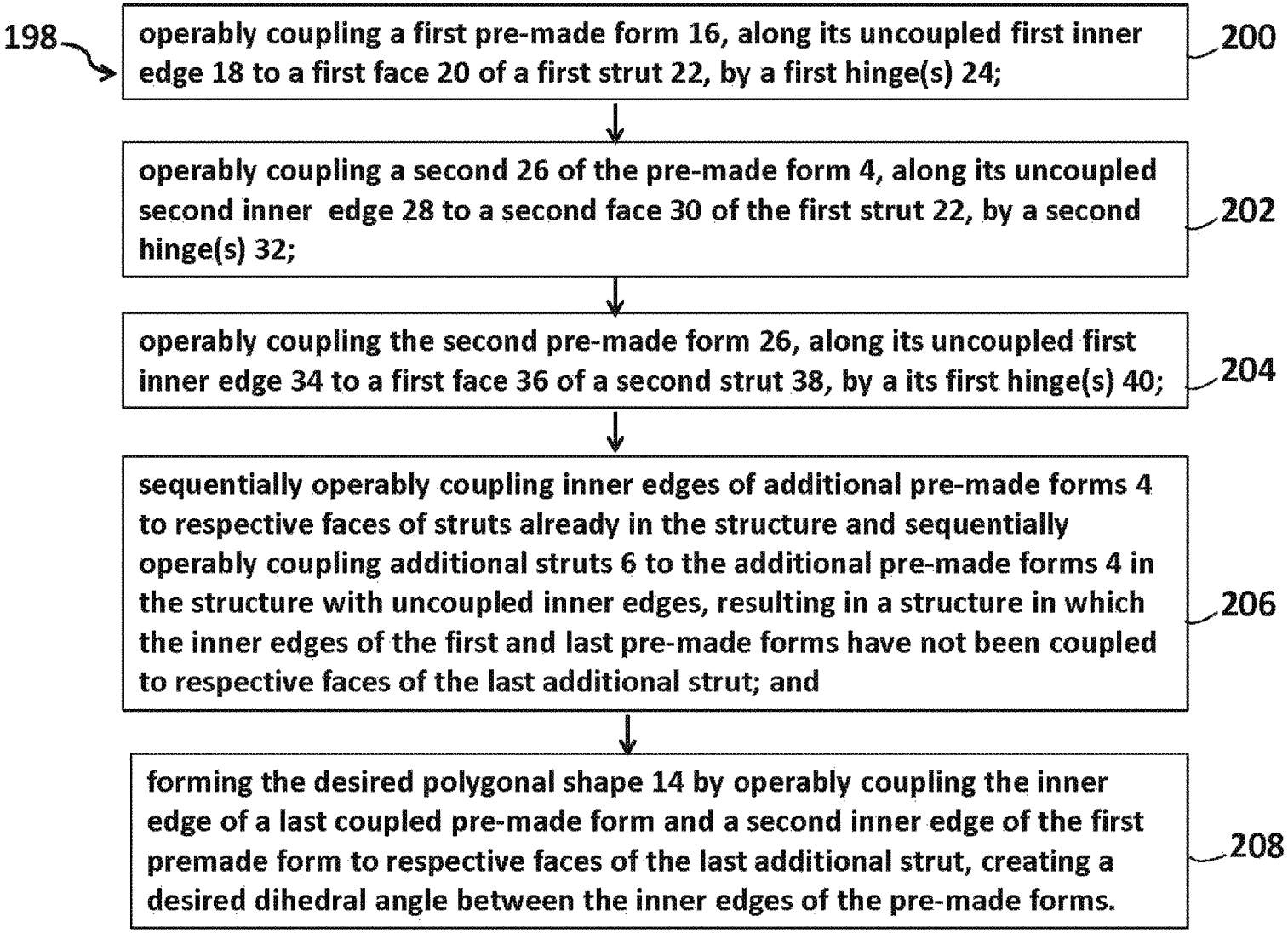
FIG. 9 depicts a method of assembling a geodesic shape, in accordance with embodiments of the present invention.

FIG. 9 depicts a flow diagram of a method 198 for assembling a desired polygonal shape 14 using the pre-made forms 4 and struts 6. The desired polygonal shape 14 is assembled using the method 198 in several steps. The first step 200 comprises operably coupling a first pre-made form 16, along its uncoupled first inner edge 18 to a first face 20 of a first strut 22, by a first hinge(s) 24. The second step 202 comprises operably coupling a second 26 pre-made form 4, along its uncoupled second inner edge 28 to a second face 30 of the first strut 22, by a second hinge(s) 32. The third step 204 comprises operably coupling the second pre-made form 26, along its uncoupled first inner edge 34 to a first face 36 of a second strut 38, by a its first hinge(s) 40. The fourth step 206 comprises sequentially operably coupling inner edges of additional pre-made forms 4 to respective faces of struts already in the structure and sequentially operably coupling additional struts 41 to the additional pre-made forms 42 in the structure with uncoupled inner edges, resulting in a structure in which the inner edges of the first and last pre-made forms have not been coupled to respective faces of the last additional strut 47. The fifth step 208 comprises forming the desired polygonal shape 14 by operably coupling the inner edge of a last coupled pre-made form and a second inner edge 19 of the first premade form to respective faces of the last additional strut, creating a desired dihedral angles $\theta_1$, $\theta_2$ between the inner edges of the pre-made forms and creating desired axial angles $\theta_3$ between a z axis of the desired polygonal shape and the inner face of each premade form. The total number of pre-made forms in the polygonal shape 14 is either five, as shown in FIG. 2A-B, or six, as shown in FIG. 1E. The resulting desired polygonal shape 14 and additional desired polygonal shapes 14 made using the same steps are connected at preset angles in known geodesic form and function, so that the desired polygonal shapes combine to form a desired geodesic shape 44, as shown in FIG. 1E. Throughout the process, no struts are operably coupled to other struts.

Figure 10:
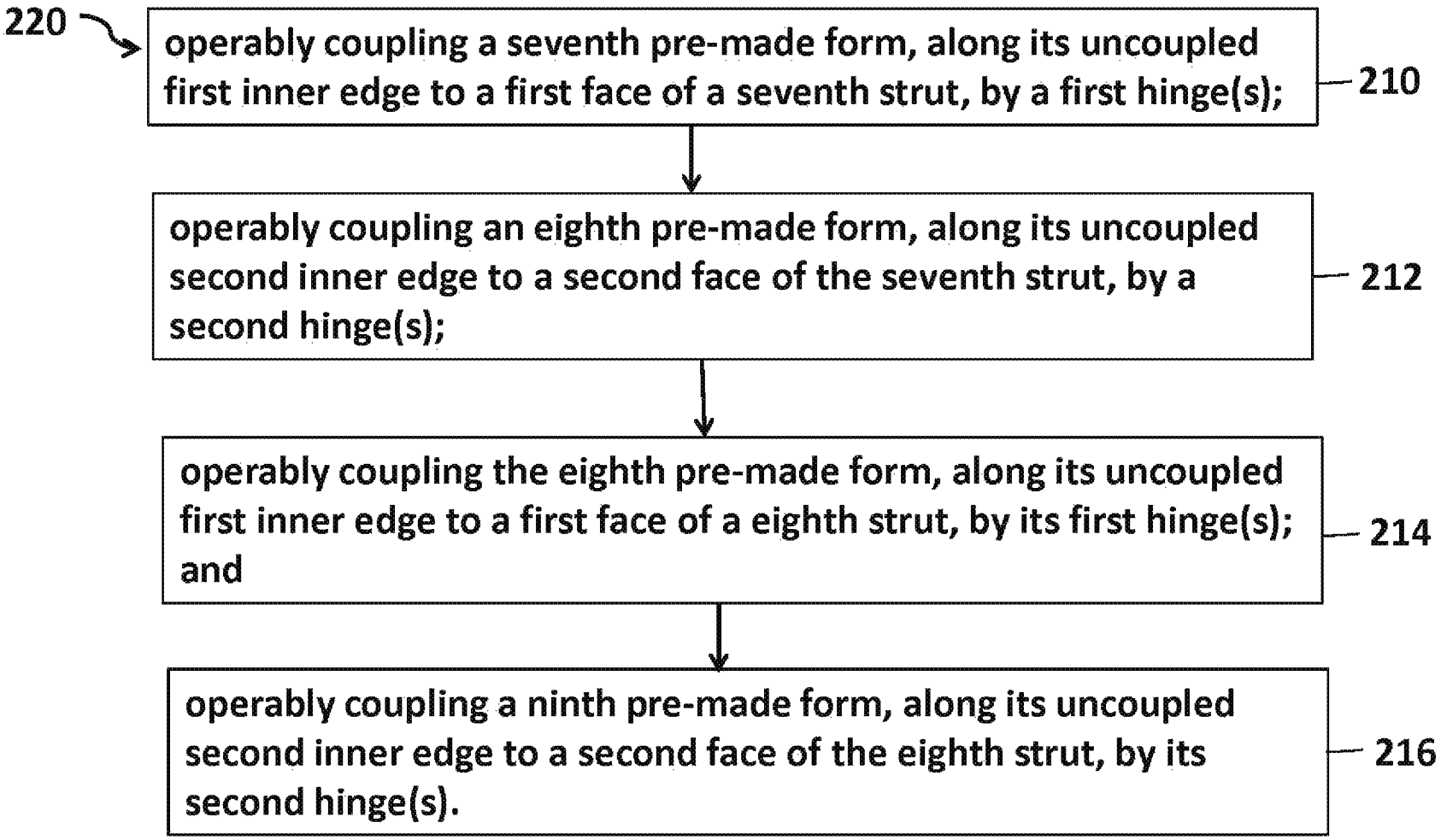
FIG. 10 depicts a flow diagram of a method for assembling a polygonal patch, in accordance with embodiments of the present invention.

FIG. 10 depicts a flow diagram listing the steps of a method 220 for assembling a polygonal patch 222, as shown in FIG. 1F, and described in associated text, herein. The first step 210 of the method 220 involves operably coupling a seventh pre-made form 124, along its uncoupled first inner edge to a first face of a seventh strut 126, by a first hinge(s) 128. A second step 212 involves operably coupling an eighth pre-made form 130, along its uncoupled second inner edge to a second face 133 of the seventh strut 126, by a second hinge(s). A third step 214 involves operably coupling the eighth pre-made form, along its uncoupled first inner edge 132 to a first face 136 of an eighth strut 135, by its first hinge(s) 138. A fourth step 216 involves operably coupling a ninth pre-made form 140, along its uncoupled second inner edge to a second face 142 of the eighth strut 134, by its second hinge(s) 144.

Figure 11:
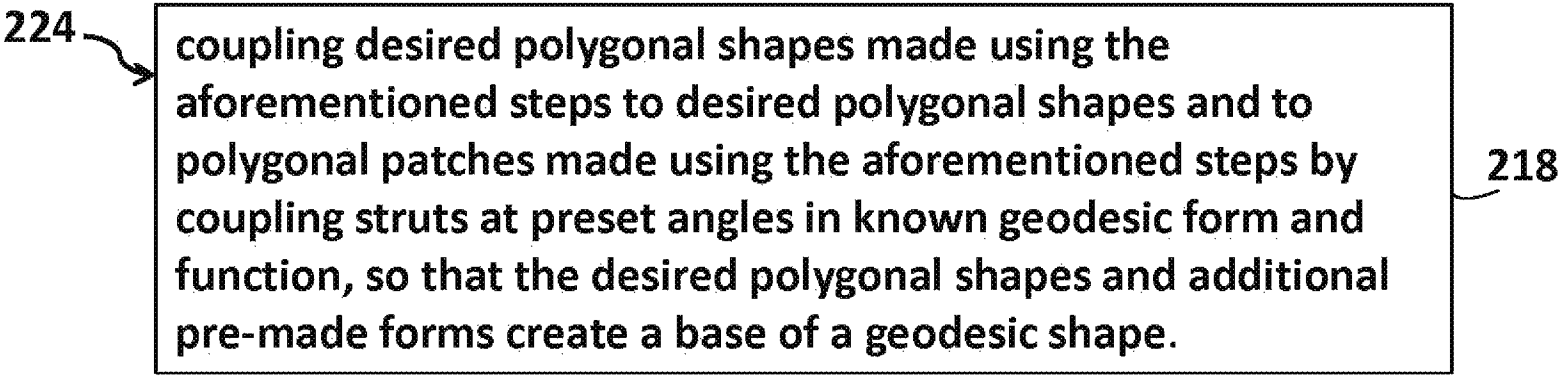
FIG. 11 depicts a flow diagram of a method for assembling a geodesic shape, in accordance with embodiments of the present invention.

FIG. 11 depicts a flow chart listing the steps of a method 224 for assembling a geodesic shape 2, as shown in FIG. 1E. The method 224 comprises a first step 218, coupling desired polygonal shapes 14 made using the aforementioned steps to desired polygonal shapes 14, premade forms 4, and to polygonal patches 222 made using the aforementioned steps by coupling their outer edges in known geodesic form and function, so that the desired polygonal shapes, polygonal patches, and additional pre-made forms create a desired geodesic shape 44.

Throughout the entire method, no struts are operably coupled to other struts. Throughout the entire method, the free range of motion of each strut-panel interface 146 of each panel along its axis aligns itself into the ideal axial and dihedral angles for the desired geodesic shape spontaneously as the assembly progresses, without any additional measurement or cutting by the user.

Figure 8:
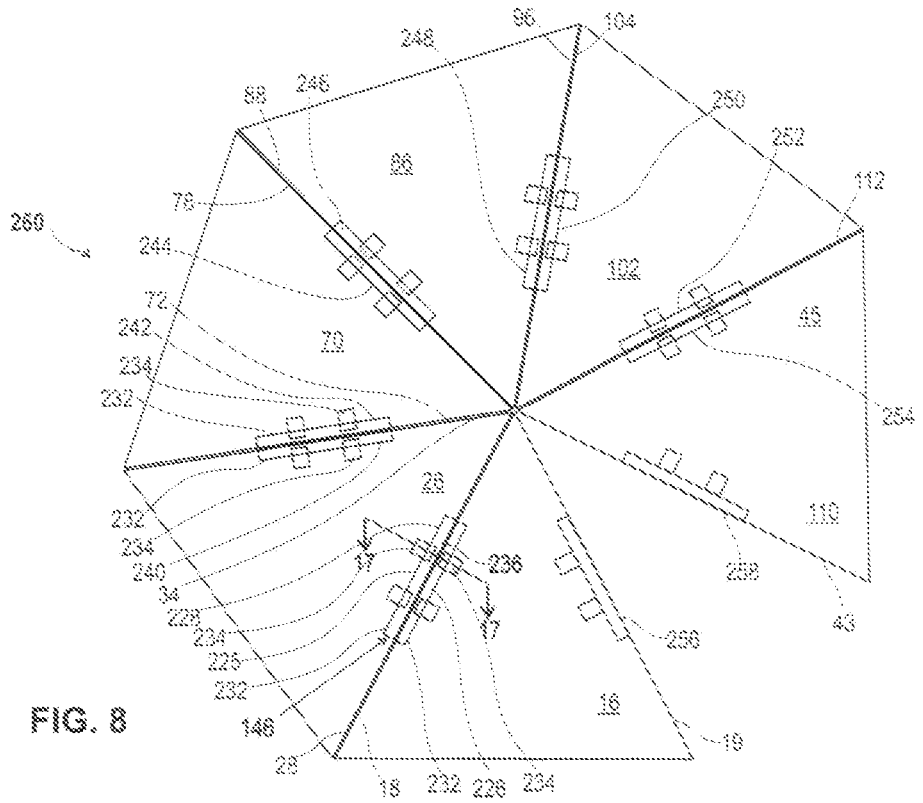
FIG. 8 depicts a front elevation view of a hexagonal polygonal shape using partial struts, in accordance with embodiments of the present invention.

FIG. 8 depicts a front elevation view of a hexagonal polygonal shape using partial struts 226, 228. In an embodiment a number of struts are comprised of first partial struts and second partial struts 226, 228, as shown in FIG. 8. The first pre-made form 16 is operably coupled along its uncoupled first inner edge 8 to a first partial strut 226, by a first hinge(s) 24. A second pre-made form 26 is operably coupled along its uncoupled second inner edge to a second partial strut 228, by a second hinge(s) 32. The first partial strut 226 is operably coupled to the second partial strut 228, forming a complete strut. No complete struts are operably coupled to other complete struts.

In one embodiment, the hinges 23 are within two inches of the outside edges of the pre-made forms. In an embodiment, after the desired polygonal shape is created a compression hinge is operably coupled to a common joint of the pre-made forms comprising the polygonal shape 14 where an axial angle is formed.

In an embodiment, gaps 46 in the desired geodesic shape 44 that are not covered by the desired polygonal shapes are covered by additional pre-made forms 4 shaped to cover the gaps.

Figure 16A:
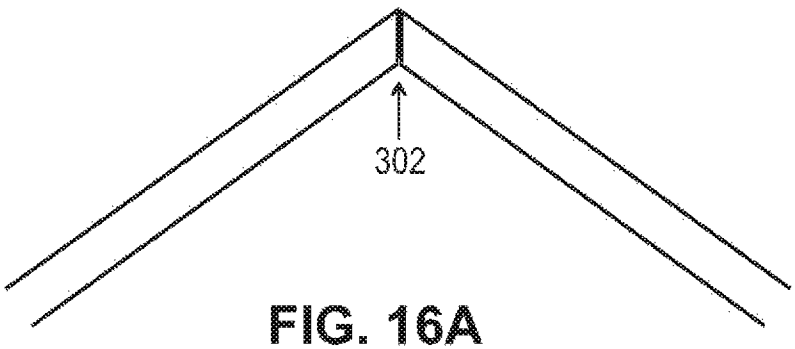
FIGS. 16A and 16B depict a cross-sectional view of the interface between two panels, in accordance with embodiments of the present invention.
Figure 16B:
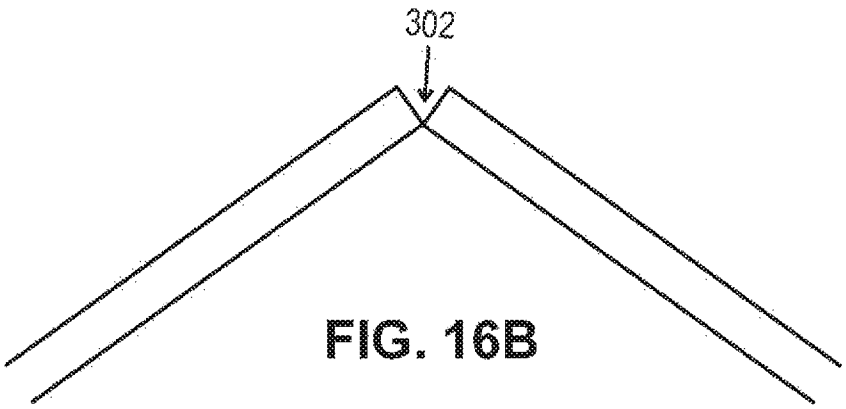

FIGS. 16A and 16B depict a cross-sectional view of the interface between two panels 4. In an embodiment, all pre-made forms 4 and all struts 6 have been cut and shaped before on site construction. In an embodiment, the pre-made forms have beveled edges 302, which allow the pre-made forms to come together without gaps in the structure, as shown in FIGS. 16A and 16B.

Figure 4A:
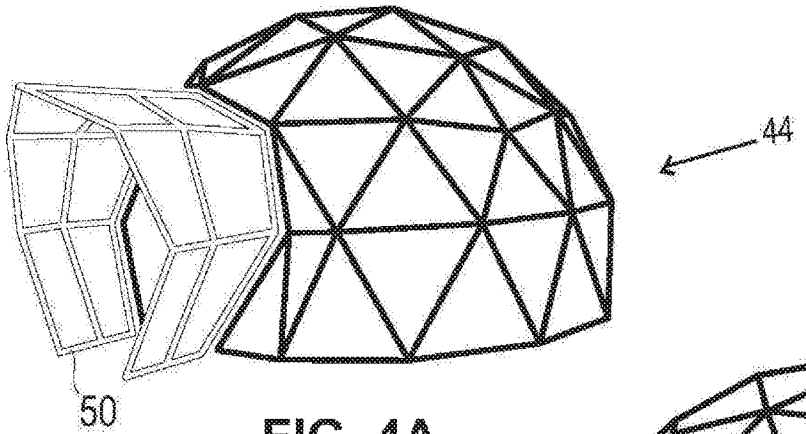
FIGS. 4A-C depict side elevation views of an assembled geodesic shape with extension doors or windows, bump out doors or windows, or rectilinear doors or windows in accordance with embodiments of the present invention.
Figure 4B:
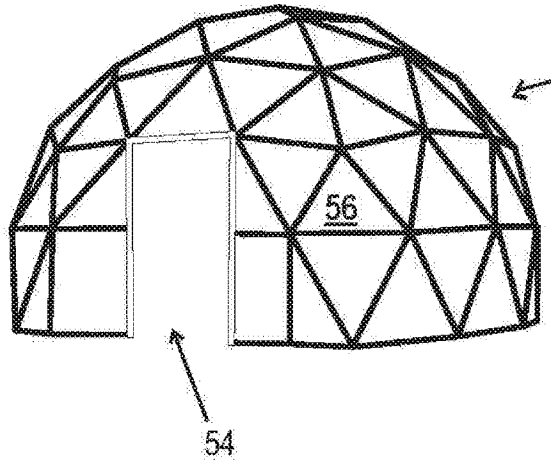
Figure 4C:
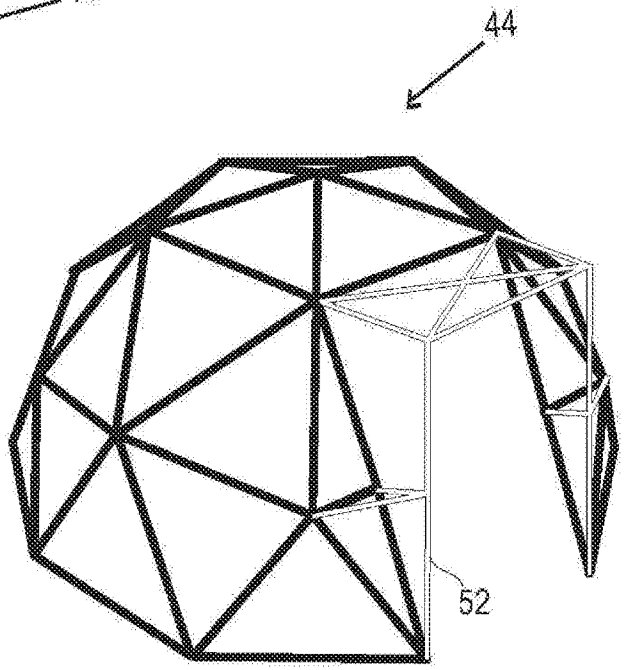

FIGS. 4A-C depict side elevation views of an assembled geodesic shape 44 with extension doors or windows 50, bump out doors or windows 52, or rectilinear doors or windows 54 in accordance with embodiments of the present invention. In an embodiment, the desired geodesic shape is selected from the group consisting of a full sphere, dome, or a partial sphere where individual desired polygonal shapes have been omitted so as to leave space for a doorway or window.

In an embodiment, one or more of the premade forms are transparent 56, in order to serve as a window.

In an embodiment, the polygonal shapes omitted to leave space for a doorway or window are used to create extension doors or windows 52, bump out doors or windows 54 or rectilinear bump out doors or windows 56.

In an embodiment, the geodesic structure has a frequency of 4.

In an embodiment, the geodesic structure has a diameter of 40 feet, and there are 30 pre-made forms with sides measuring 5'0¾" by 5'10-⅞" by 5'0-¾", 30 pre-made forms measuring 5'10-⅝" by 5'10-⅞" by 5'10-⅝", 60 pre-made forms measuring 5'10-⅝" by 6'3⅛" by 5'11-⅝", 30 pre-made forms measuring 6'3⅛" by 6'6" by 6'3⅛", and 10 pre-made forms measuring 6'6 by 6'6 by 6'6.

In an embodiment, the hinges are utility hinges.

In an embodiment, the desired geodesic shape 44 is watertight and/or vapor tight.

Figure 5:
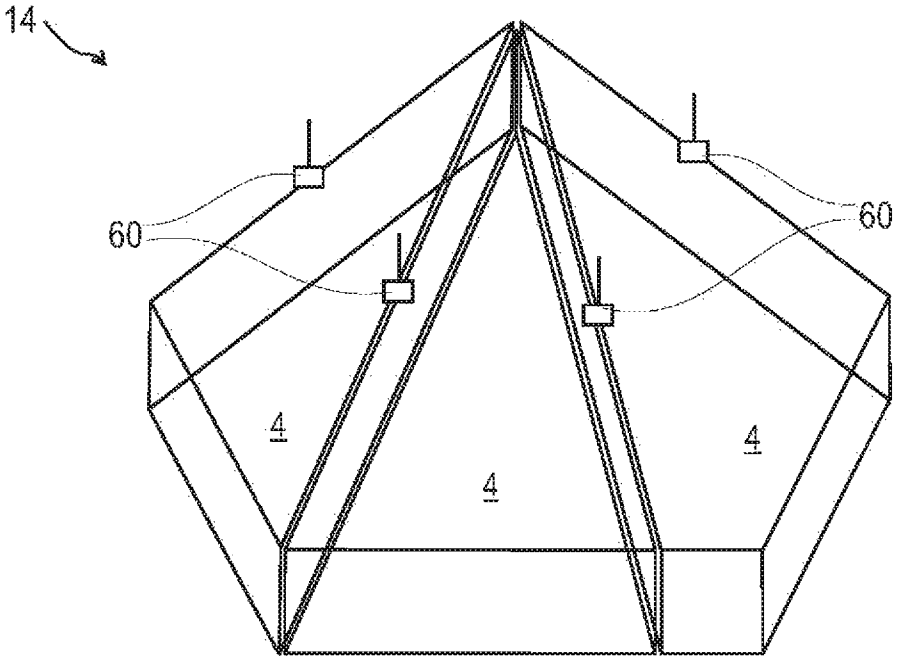
FIG. 5 depicts a front elevation view of a polygonal shape with anchors attached, in accordance with embodiments of the present invention.

FIG. 5 depicts a front elevation view of a polygonal shape with anchors 60 attached. In an embodiment, anchors 60 are attached to the desired polygonal shape, and concrete 62 is poured onto the desired polygonal shape, as shown in FIG. 5. Once the concrete has set, a crane lifts the desired polygonal shape into place.

In an embodiment, the desired polygonal shapes are removed after the concrete has set in place.

In an embodiment, the forms 4 create a desired tile or panel finish that remains on the interior of the concrete dome.

Figure 6:
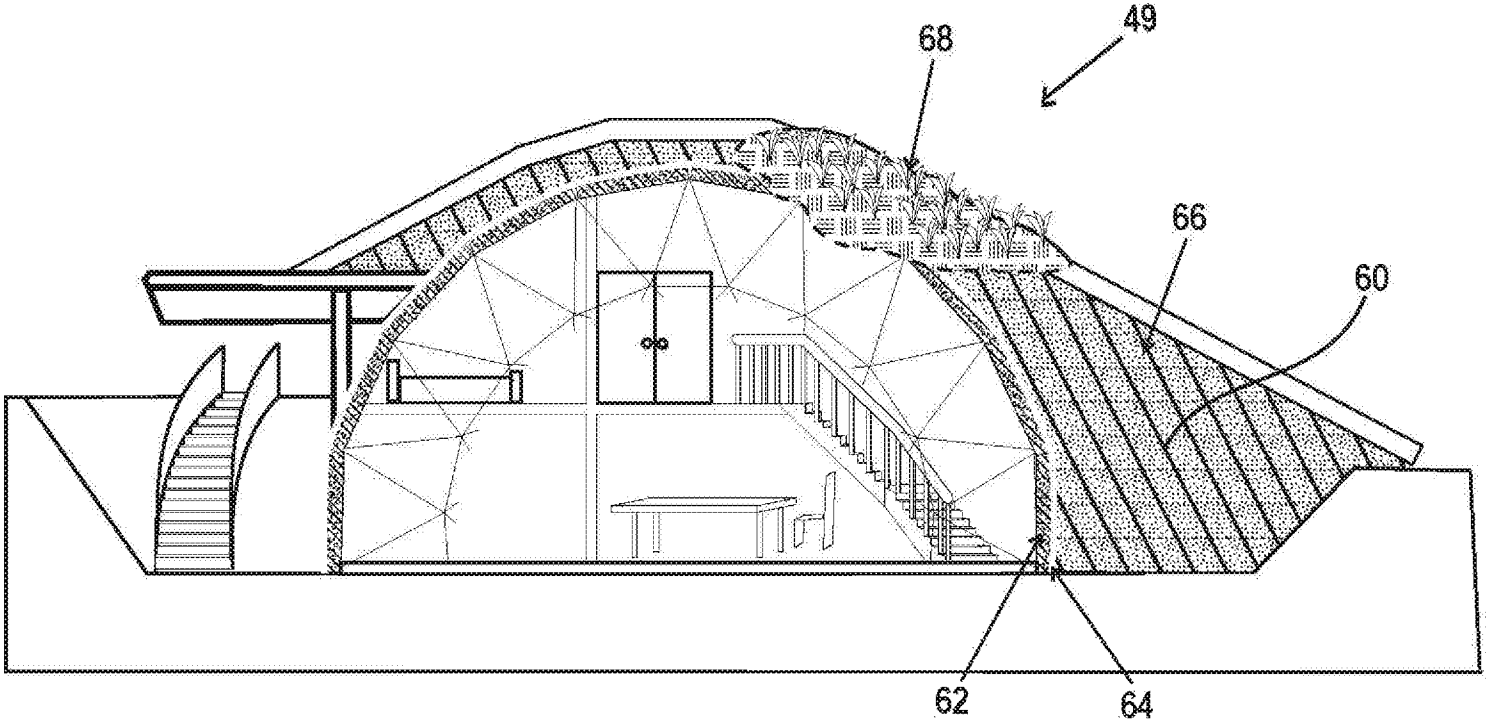
FIG. 6 depicts a front elevation view of a dirt exterior layer with vegetation on a desired geodesic shape, in accordance with embodiments of the present invention.

FIG. 6 depicts a dirt exterior layer 66 with vegetation 68 on a desired geodesic shape 49. In an embodiment, after the concrete 62 has set, a watershed insulating blanket 64 (a waterproof layer) is placed on top of the concrete layer, and an exterior layer 66 is place on top of the waterproof layer, as shown in FIG. 6.

In an embodiment, the exterior layer 66 is dirt, sod, or turf.

In an embodiment, vegetation 68 is encouraged to grow on the exterior layer of dirt, sod, or turf, as shown in FIG. 6.

Figure 7:
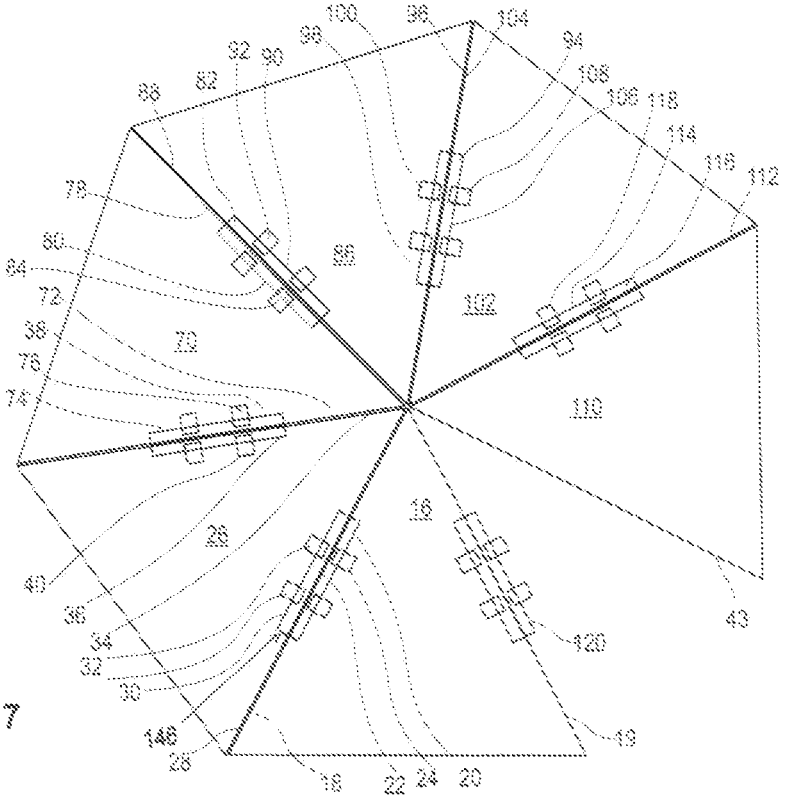
FIG. 7 depicts the hexagonal polygonal shape depicted in FIG. 1E, in accordance with embodiments of the present invention.

FIG. 7 depicts the hexagonal polygonal shape depicted in FIG. 1E before it has been raised, so that the inner edge 43 of a last coupled pre-made form 110 and a second inner edge 19 of the first premade form 16 are operably coupled to respective faces of the last additional strut, creating a desired dihedral angles $\theta_1$, $\theta_2$ between the inner edges of the pre-made forms, and creating a desired axial angles $\theta_3$ between a z axis 51 of the desired polygonal shape and the inner face 49 of each premade form, thus forming the desired polygonal shape 14. A second aspect of the present invention provides an apparatus for making a polygonal shape, as shown in FIG. 7. The apparatus is comprised of five or six struts 6 each with a first face operably coupled to a first hinge(s) and second face operably coupled a second hinge(s), and five or six pre-made forms 4 which are triangular in shape, with first and second inner edges, an inner face 11 and an outer face 13, and an outer edge. The lengths of each inner edges and the outer edge of the pre-made form are determined by the frequency of the geodesic shape, diameter of the geodesic shape, and known formulas for relating diameter and frequency to create a geodesic dome. A first pre-made form 16 is operably coupled along its first inner edge 18 to the first face 20 of a first strut 22 by first hinge(s) 24. A second pre-made form 26 is operably coupled along its second inner edge 28 to a second face 30 of the first strut 22, by its second hinge(s) 32. The second pre-made form 26 is then operably coupled along its first inner edge 34 to a first face 36 of a second strut 38, by its first hinge(s) 40. A third pre-made form 70 is then operably coupled along its second inner edge 72 to the second face 74 of the second strut 38 by its second hinge(s) 76. The third pre-made form 70 is operably coupled along its first inner edge 78 to a first face 80 of a third strut 82, by its first hinge(s) 84. A fourth pre-made form 86 is operably coupled along its second inner edge 88 to a second face 90 of the third strut 82, by its second hinge(s) 92. The fourth pre-made form 86 is operably coupled along its first inner edge 96 to a first face 98 of the fourth strut 94, by its first hinge(s) 100. A fifth pre-made form 102 may be operably coupled along its second inner edge 104 to a second face 106 of the fourth strut 100, by its second hinge(s) 108 if there is a sixth pre-made form 110, as shown in FIG. 7. The fifth pre-made form 102 may be operably coupled along its first inner edge 112 to a first face 114 of the fifth strut 116, by its first hinge(s) 118 if there is a sixth strut 120. A desired polygonal shape 14 is formed by operably coupling the inner edge 43 of a final pre-made form and a second inner edge 10 of the first premade form to respective faces of the last additional strut, creating desired dihedral angles $\theta_1$, $\theta_2$ between the inner edges of the pre-made forms and creating desired axial angles $\theta_3$ between a z axis of the desired polygonal shape and the inner face of each premade form. Throughout creation of the desired polygonal shape 14, no struts 6 are operably coupled to other struts. The free range of motion of each strut-panel interface of each panel along its axis aligns itself into the ideal axial and dihedral angles for the desired geodesic shape spontaneously as the assembly progresses, without any additional measurement or cutting by the user.

In an embodiment, all pre-made forms 4 and all struts 6 have been cut and shaped before on site construction.

In an embodiment, there is a kit for making a desired geodesic shape. The kit is comprised of several of the desired polygonal shapes 14 acting in concert. along with additional pre-made forms 4 having shapes determined by the frequency of the geodesic shape, diameter of the geodesic shape, and known formulas for relating diameter and frequency when creating a geodesic dome or sphere, designed to cover gaps 46 in the desired geodesic shape 44 that are not covered by the desired polygonal shapes 14. The desired polygonal shapes 14 and the additional pre-made forms 4 act in concert, and are operably coupled at preset angles in known geodesic form and function, so that the desired polygonal shapes 14 combine to form a desired geodesic shape 44 without any changes or modifications to any of the struts 6 or pre-made forms 4. Throughout creation of the desired geodesic shape 44, no struts 6 are operably coupled to other struts.

In an embodiment, wherein the desired geodesic shape 44 is selected from the group consisting of a full sphere, half sphere, or a partial sphere where individual polygons have been omitted so as to leave space for a doorway or window.

In an embodiment, the hinges are utility hinges.

In an embodiment, the desired geodesic shape 44 has a frequency of 4 and a 40 foot diameter, so that each polygonal shape 14 weighs a maximum of 5,000 pounds. In a preferred embodiment, each polygonal shape 14 weighs a maximum of 4,500 pounds.

In an embodiment, the geodesic structure has a diameter of 40 feet and there are 30 pre-made forms with sides measuring 5'0¾" by 5'10-⅞" by 5'0¾", 30 pre-made forms measuring 5'10-⅝" by 5'10-⅞" by 5'10-⅝", 60 pre-made forms measuring 5'10-⅝" by 6'3⅛" by 5'11-⅚", 30 pre-made forms measuring 6'3⅛" by 6'6" by 6'3⅛", and 10 pre-made forms measuring 6'6 by 6'6 by 6'6.

In an embodiment, the desired geodesic shape is water-tight and/or vapor tight.

In an embodiment, anchors 60 are attached to the desired polygonal shape, concrete 62 is poured onto the desired polygonal shape, and once the concrete 62 has set a crane lifts the desired polygonal shape into place.

With a full of set of parts, the full concrete form 62 can be put up within a day and a half onsite without recutting or otherwise customizing the struts or pre-made forms.

In an embodiment, the pre-made forms create a desired tile or panel finish that remains on the interior of the concrete dome.

In an embodiment, after the concrete has set, a watershed insulating blanket 64 (a waterproof layer) is placed on top of the concrete layer, and an exterior layer 66 is placed on top of the waterproof layer 64.

In an embodiment, the desired geodesic shape is a frequency 4 and a 40 foot diameter, so that each polygon weighs a maximum of 5,000 pounds.

In an embodiment, the geodesic structure has a diameter of 40 feet and there are 30 pre-made forms with sides measuring 5'0¾" by 5'10-⅞" by 5'0¾", 30 pre-made forms measuring 5'10-⅝" by 5'10-⅞" by 5'10-⅝", 60 pre-made forms measuring 5'10-⅝" by 6'3⅛" by 5'11-⅚", 30 premade forms measuring 6'3⅛" by 6'6" by 6'3⅛", and 10 pre-made forms measuring 6'6 by 6'6 by 6'6.

In an embodiment, the exterior layer 66 is dirt, sod, or turf. In an embodiment, vegetation 68 is encouraged to grow on the exterior layer of dirt, sod, or turf.

In an embodiment, a number of struts are comprised of first partial struts 226 and second partial struts 228. A first pre-made form 16 is operably coupled along its uncoupled first inner edge to a first face of a first partial strut 226, by a first hinge(s) 234. A second pre-made form 26 is operably coupled along its uncoupled second inner edge to a second partial strut 228, by a second hinge(s). The first partial strut is operably coupled to the second partial strut, forming a complete strut. No complete struts are operably coupled to other complete struts.

Figure 12:
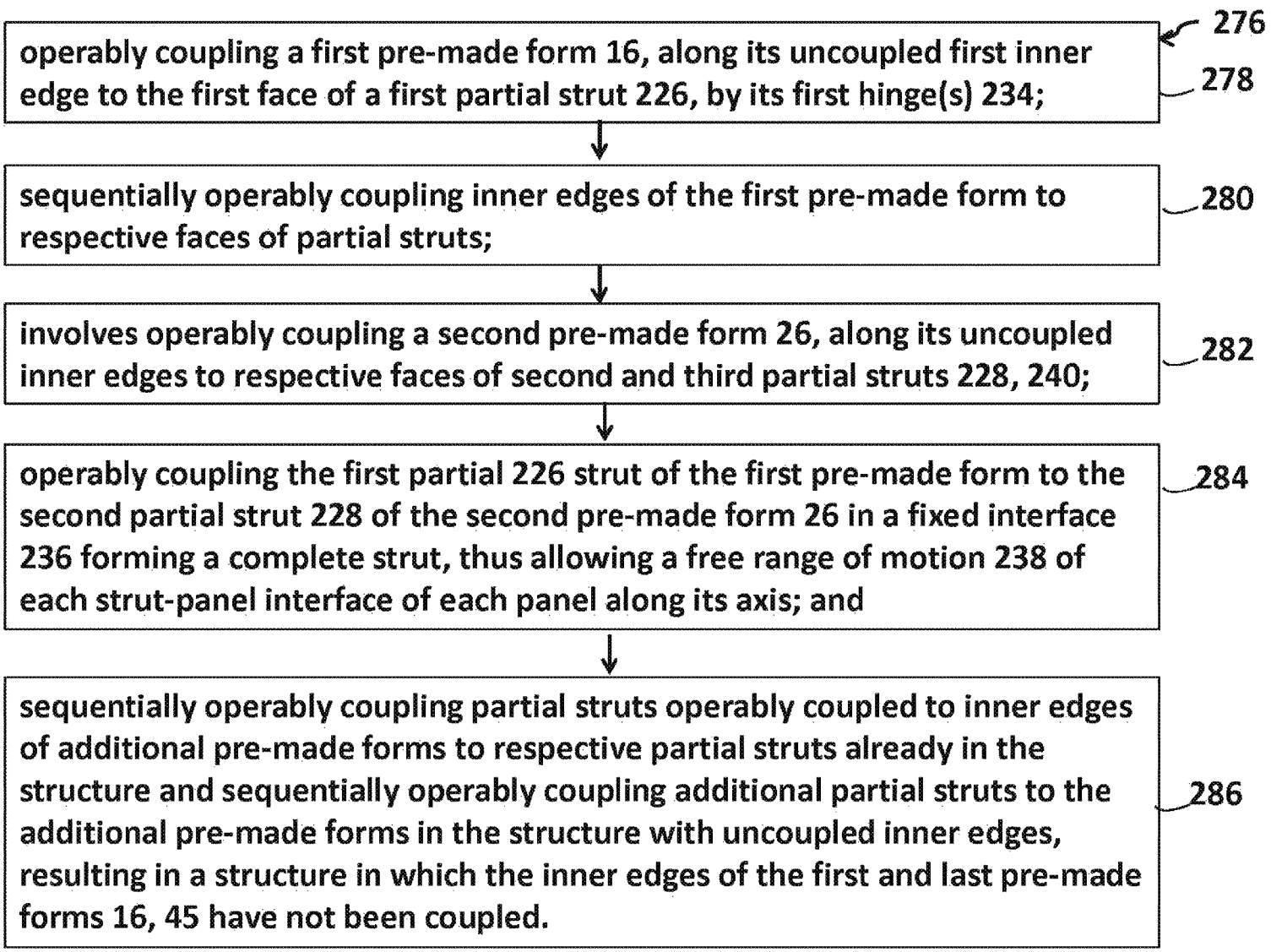
FIG. 12 depicts a flow diagram of a method of assembling a geodesic shape, in accordance with embodiments of the present invention.

FIG. 12 depicts a flow diagram of a method 276 of assembling a precursor geodesic shape 260 depicted in FIG. 8 and described in associated text, herein. The method 276 includes steps for assembling a desired geodesic shape 2, 44 from a plurality of triangular pre-made forms having a triangular shape, first and second inner edges, an inner face 11 and an outer face 13, and an outer edge. The length of each inner edge and outer edge are determined by the frequency of the geodesic shape, diameter of the geodesic shape, and known formulas for relating diameter and frequency when creating a geodesic dome or sphere. The method includes steps 278, 280, 282, 284, and 286 for assembling a polygonal shape. The first step 278 involves operably coupling a first pre-made form 16, along its uncoupled first inner edge to the first face of a first partial strut 226, by its first hinge(s) 234. The second step 280 involves sequentially operably coupling inner edges of the first pre-made form to respective faces of partial struts. The third step 282 involves operably coupling a second pre-made form 26, along its uncoupled inner edges to respective faces of second and third partial struts 228, 240. The fourth step 284 involves operably coupling the first partial 226 strut of the first pre-made form to the second partial strut 228 of the second pre-made form 26 in a fixed interface 236 forming a complete strut, thus allowing a free range of motion 238 of each strut-panel interface of each panel along its axis. The fifth step 286 involves sequentially operably coupling partial struts operably coupled to inner edges of additional pre-made forms to respective partial struts already in the structure and sequentially operably coupling additional partial struts to the additional pre-made forms in the structure with uncoupled inner edges, resulting in a structure in which the inner edges of the first and last pre-made forms 16, 45 have not been coupled. The desired polygonal shape is formed by operably coupling a partial strut 258 operably coupled to an inner edge of a last coupled pre-made form 45 and a partial strut 256 operably coupled to a second inner edge of the first premade form 16 in a fixed interface forming a complete strut, creating desired dihedral angles between the inner edges of the pre-made forms and creating a desired axial angles $\theta_3$ between a z axis of the desired polygonal shape and the inner face of each premade form. The total number of pre-made forms in the polygonal shape is either five or six. The method includes steps 288 for assembling a polygonal patch 222, as shown in the flowchart of FIG. 13.

Figure 13:
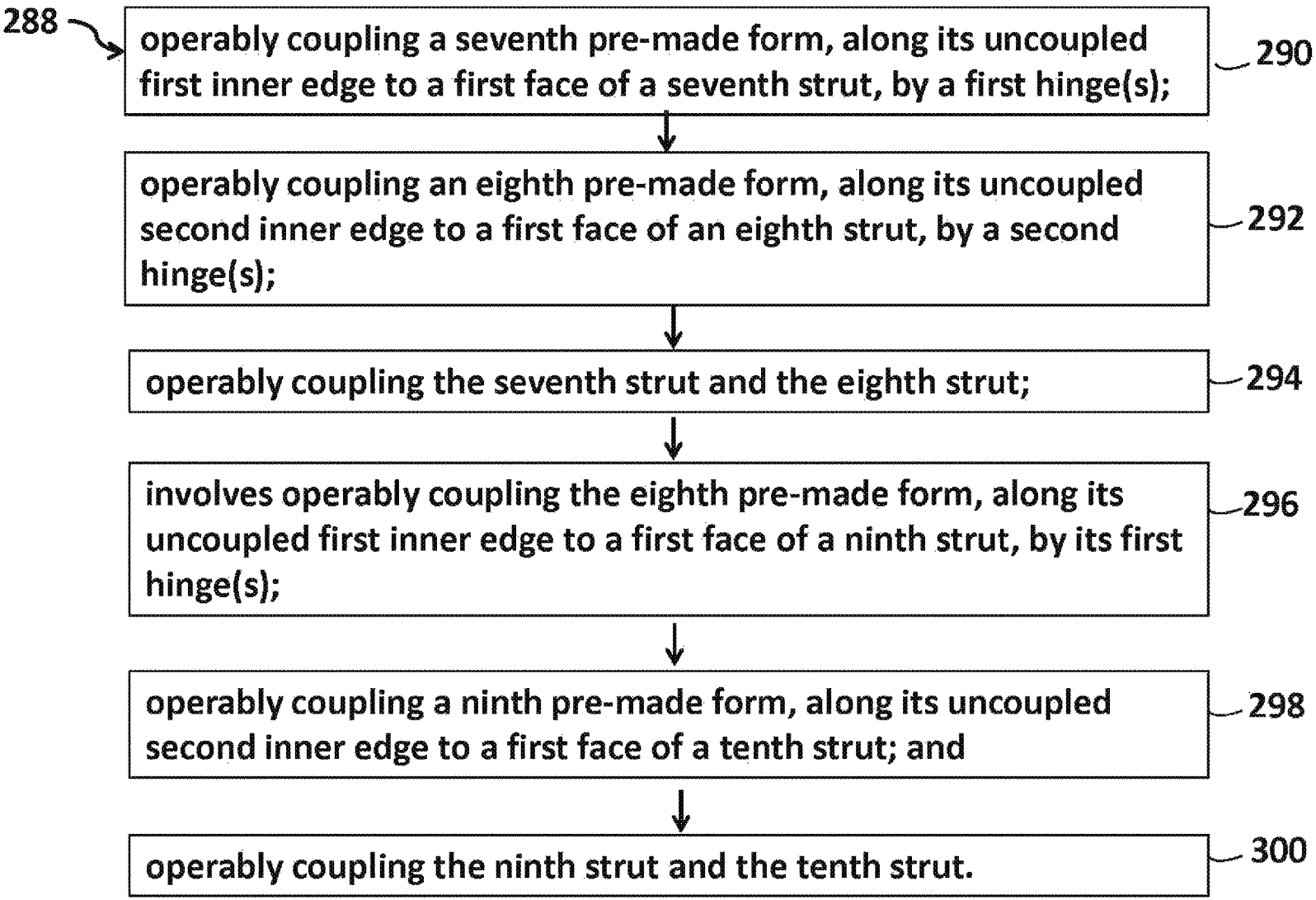
FIG. 13 depicts a flow diagram of a method for assembling a polygonal patch, in accordance with embodiments of the present invention.

FIG. 13 depicts a flow chart of a method for assembling a polygonal patch. The first step 290 involves operably coupling a seventh pre-made form, along its uncoupled first inner edge to a first face of a seventh strut, by a first hinge(s). The second step 292 involves operably coupling an eighth pre-made form, along its uncoupled second inner edge to a first face of an eighth strut, by a second hinge(s). The third step 294 involves operably coupling the seventh strut and the eighth strut 135. The fourth step 296 involves operably coupling the eighth pre-made form, along its uncoupled first inner edge to a first face of a ninth strut, by its first hinge(s). The fifth step 298 involves operably coupling a ninth pre-made form, along its uncoupled second inner edge to a first face of a tenth strut. The sixth step 300 includes operably coupling the ninth strut and the tenth strut.

Figure 14:
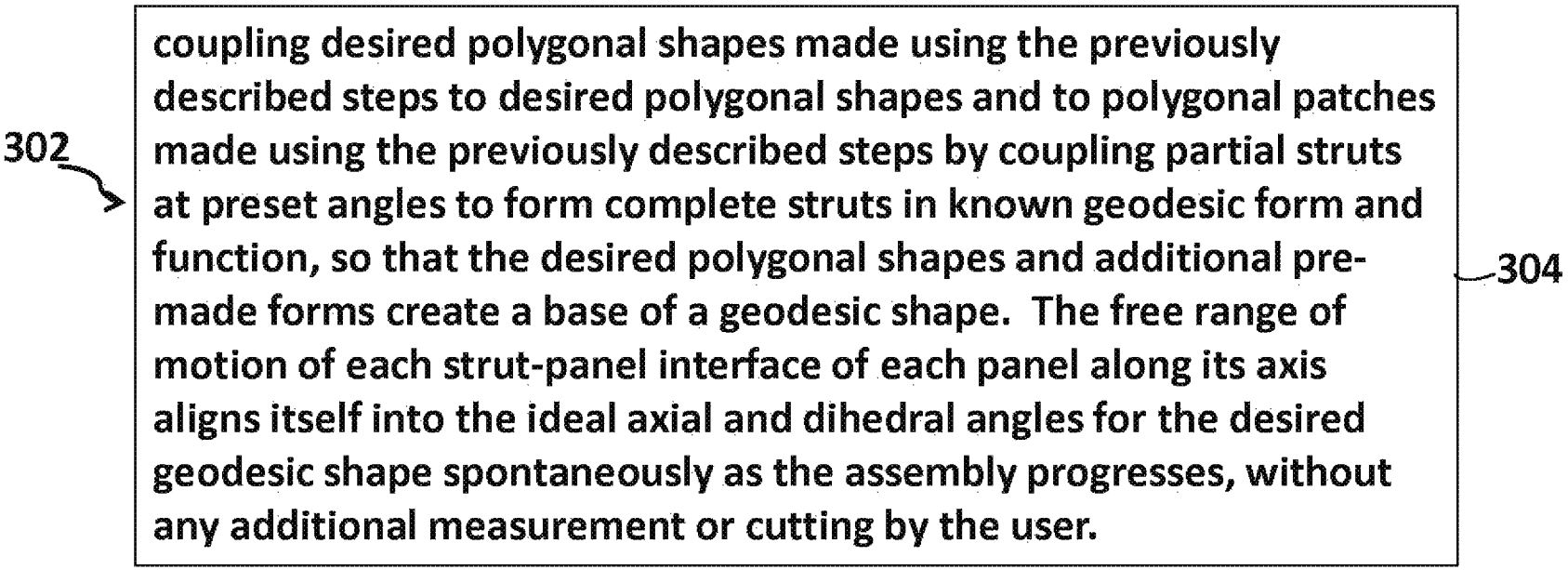
FIG. 14 depicts a flow diagram of a method for assembling a geodesic shape, in accordance with embodiments of the present invention.

FIG. 14 depicts a flow diagram of a method for assembling a geodesic shape. The method includes steps 302 for assembling a geodesic shape, as shown in FIG. 14. The first step 304 includes coupling desired polygonal shapes made using the previously described steps to desired polygonal shapes, premade forms, and to polygonal patches made using the previously described steps by coupling their outer edges in known geodesic form and function, so that the desired polygonal shapes, polygonal patches, and additional pre-made forms create a geodesic shape. The free range of motion of each strut-panel interface of each panel along its axis aligns itself into the ideal axial and dihedral angles for the desired geodesic shape spontaneously as the assembly progresses, without any additional measurement or cutting by the user. Throughout the entire process, no complete struts are operably coupled to other complete struts.

FIG. 8 depicts a front elevation view of a hexagonal polygonal shape using partial struts 226, 228. The apparatus includes ten or twelve partial struts 225 each with a first face 232 operably coupled to a first hinge(s) 234. The apparatus has five or six pre-made forms 4 comprised of a triangular shape, first and second inner edges 8, 10, an inner face 11 and an outer face 13, and an outer edge 12. The length of each inner edges and outer edge are determined by the frequency of the geodesic shape, diameter of the geodesic shape, and known formulas for relating diameter and frequency to create a geodesic dome. The apparatus has a first pre-made form 16 and a first partial strut 226. The first pre-made form 16 is operably coupled along its first inner edge to a first face 232 of a first partial strut 226 by a first hinge(s) 234. The apparatus has a second pre-made form 26. The second pre-made form 26 is operably coupled along its second inner edge 28 to a first face 232 of a second partial strut 228, by its first hinge(s) 234. The first partial strut 226 and the second partial strut 228 are operably coupled in a fixed interface 236 forming a complete strut, thus allowing a free range of motion 238 of each strut-panel interface of each panel along its axis. The apparatus includes a third partial strut 240. The second pre-made form 26 is operably coupled along its first inner edge to a first face 232 of the third partial strut 240, by its first hinge(s) 234. The apparatus includes a third pre-made form 70, where the third pre-made form 70 is operably coupled along its second inner edge to a first face 232 of a fourth partial strut 242 by its first hinge(s) 234. The third partial strut 240 and the fourth partial strut 242 are operably coupled in a fixed interface 236 forming a complete strut, thus allowing a free range of motion 238 of each strut-panel interface of each panel along its axis. The apparatus includes a fifth partial strut 244, where the third pre-made form 70 is operably coupled along its first inner edge to a first face 232 of the fifth partial strut 244, by its first hinge(s) 234. The apparatus includes a fourth pre-made form 86, where the fourth pre-made form is operably coupled along its second inner edge to a first face 232 of a sixth partial strut 246, by its first hinge(s) 234. The fifth partial strut 244 and the sixth partial strut 246 are operably coupled in a fixed interface 236 forming a complete strut, thus allowing a free range of motion of each strut-panel interface of each panel along its axis. The apparatus includes a seventh partial strut 248, where the fourth pre-made form 86 is operably coupled along its first inner edge to a first face of the seventh partial strut, by its first hinge(s). The apparatus includes a fifth pre-made form 102, where the fifth pre-made form may be operably coupled along its second inner edge to a first face of the eighth partial strut 250, by its second hinge(s) if there is a sixth pre-made form 110. The seventh partial strut 248 and the eighth partial strut 250 are operably coupled in a fixed interface forming a complete strut, thus allowing a free range of motion of each strut-panel interface of each panel along its axis if there is a sixth pre-made form. The apparatus includes a ninth partial strut 252, where the fifth pre-made form 102 may be operably coupled along its first inner edge to a first face of the ninth partial strut 252, by its first hinge(s) if there is a sixth partial strut 246. A desired polygonal shape is formed by operably coupling the inner edge of a final pre-made form to the ninth partial strut 252 and a second inner edge of the first premade form to respective faces of a tenth partial strut 254 and operably coupling the ninth and tenth partial struts in a fixed interface forming a complete strut, creating desired dihedral angles between the inner edges of the pre-made forms and creating a desired axial angles $\theta_3$ between a z axis of the desired polygonal shape and the inner face of each premade form. The free range of motion of each strut-panel interface of each panel along its axis aligns itself into the ideal axial and dihedral angles for the desired geodesic shape spontaneously as the assembly progresses, without any measurement or cutting by the user. Throughout the apparatus, no complete struts are operably coupled to other complete struts.

In an embodiment, all pre-made forms 4 and all partial struts 225 have been cut and shaped before on site construction.

Figure 15:
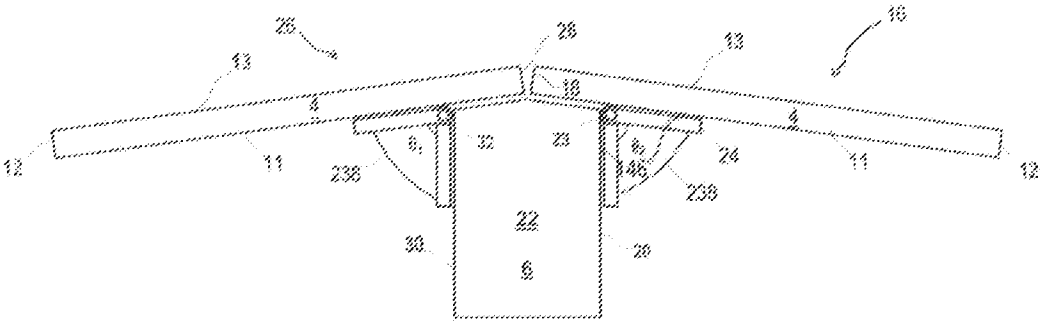
FIG. 15 depicts a front view of a panel-to-adjacent strut interface, in accordance with embodiments of the present invention.

FIG. 15 depicts a front view of a panel-to-adjacent strut interface 146, taken along the line 15-15 in FIG. 1B, showing the free range of motion 238 of the desired dihedral angles $\theta_1$, $\theta_2$ between the pre-made forms 4 and the struts 6.

Figure 17:
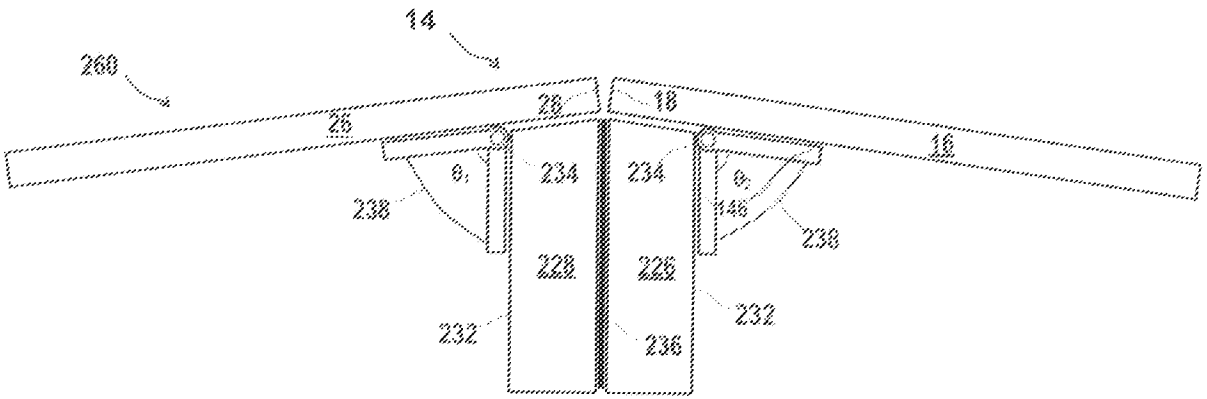
FIG. 17 depicts a front view of a panel-to-adjacent strut interface, in accordance with embodiments of the present invention.

FIG. 17 depicts a front view of a panel-to-adjacent strut interface 146, taken along the line 17-17 in FIG. 8, showing the free range of motion 238 of the desired dihedral angles $\theta_1$, $\theta_2$ between the pre-made forms 26 and 16 and the partial struts 228, 226.

FIGS. 1A-1E depict the operational stages for making a polygonal shape 14 from a pre-made form 16. The polygonal shape 14 is characterized by having correct dihedral $\theta_1$, $\theta_2$ and axial angles $\theta_3$ for use in constructing a geodesic shape 2. In the method 220 a plurality of triangular pre-made forms are provided, each pre-made form having a triangular shape, first and second inner edges 8, 10, an outer edge 12, and an inner face 11 and an outer face 13. A length of each inner edge 8, 10 and outer edge 12 is determined by the frequency of the geodesic shape 2, and diameter of the geodesic shape 2. The method 220 then comprises assembling the polygonal shape 14, where the total number of pre-made forms in the polygonal shape is either five or six. There are steps 210, 212, 214 and 216 to assembling the polygonal shape 14. In the step 220, a first pre-made form 16 is operably coupled along its uncoupled first inner edge 18 to a first face 20 of a first strut 22, by a first hinge(s) 24. In step 212 a second pre-made form 26 is operably coupled along its uncoupled second inner edge 28 to a second face 30 of the first strut 22, by a second hinge(s) 32. In a step 214, the second pre-made form 26 is operably coupled along its uncoupled first inner edge 34 to a first face 36 of a second strut 38, by its first hinge(s) 40. In a step 216 a planar precursor 260 of the desired polygonal shape 14 is formed by sequentially operably coupling inner edges of additional pre-made forms to respective faces of struts already in the structure and sequentially operably coupling additional struts to the additional pre-made forms in the structure with uncoupled inner edges, resulting in a structure in which the inner edges of the first and last pre-made forms have not been coupled to respective faces of the last additional strut. In a concluding step, the desired polygonal shape 14 may be formed by raising the planar precursor 260 and operably coupling the inner edge of a last coupled pre-made form and a second inner edge of the first premade form to respective faces of the last additional strut, resulting in creating correct dihedral angles $\theta_1$, $\theta_2$ which are between the inner faces 256 of the premade forms 4 and faces 258 of the coupled struts 6 and the correct axial angles $\theta_3$ which are between a z axis of the desired polygonal shape and the inner face 256 of each premade form 4 without any additional measurement. Throughout the entirety of the assembly, no struts are operably coupled to other struts.

FIG. 1F depicts the operational stages for making a desired geodesic shape 44 from the polygonal shape. First a polygonal patch 222 is assembled. The first step of assembling a polygonal patch 222 involves operably coupling a seventh pre-made form 124, along its uncoupled first inner edge to a first face of a seventh strut 126, by a first hinge(s) 128. The second step involves operably coupling an eighth pre-made form 130, along its uncoupled second inner edge to a second face 133 of the seventh strut 126, by a second hinge(s). The third step involves operably coupling the eighth pre-made form 130, along its uncoupled first inner edge 132 to a first face 136 of an eighth strut 135, by its first hinge(s) 138. The fourth step involves operably coupling a ninth pre-made form 140, along its uncoupled second inner edge to a second face 142 of the eighth strut 134, by its second hinge(s) 144. A geodesic shape is thus assembled by coupling desired polygonal shapes made using the previously described steps to desired polygonal shapes, pre-made forms, and to polygonal patches made using the previously described steps by coupling their outer edges, so that the desired polygonal shapes, polygonal patches and additional pre-made forms create a geodesic shape. Throughout the assembly of the geodesic shape, no struts are operably coupled to other struts.

In one embodiment, a number of struts are comprised of first partial struts and second partial struts. A first pre-made form 16 is operably coupled along its uncoupled first inner edge to a first partial strut 226, by a first hinge(s) 234. A second pre-made form 26 is operably coupled along its uncoupled second inner edge to a second partial strut 228, by a second hinge(s). The first partial strut is operably coupled to the second partial strut, forming a complete strut. Throughout the assembly, no complete struts are operably coupled to other complete struts.

In one embodiment, the hinges are within two inches of the outside edges of the pre-made forms.

In one embodiment, after the desired polygonal shape is created a compression hinge is operably coupled to a common joint of the pre-made forms comprising the polygonal shape where an axial angle is formed.

In one embodiment, all pre-made forms and all struts have been cut and shaped before on site construction.

In one embodiment, the desired geodesic shape is selected from the group consisting of a full sphere, dome, or a partial sphere where individual desired polygonal shapes have been omitted so as to leave space for a doorway or window.

In one embodiment, one or more of the premade forms are transparent, in order to serve as a window.

In one embodiment, the polygonal shapes omitted to leave space for a doorway or window are used to create extension doors or windows, bump out doors or windows or rectilinear bump out doors or windows.

In one embodiment, the geodesic structure has a frequency of 4.

In one embodiment, the geodesic structure has a diameter of 40 feet;

In one embodiment, there are 30 pre-made forms with sides measuring 5'0¾" by 5'10-⅞" by 5'0¾", 30 pre-made forms measuring 5'10-⅝" by 5'10-⅞" by 5'10-⅝", 60 pre-made forms measuring 5'10-⅝" by 6'3⅛" by 5'11-⅝", 30 pre-made forms measuring 6'3⅛" by 6'6" by 6'3⅛", and 10 pre-made forms measuring 6'6 by 6'6 by 6'6.

In one embodiment, the hinges are utility hinges.

In one embodiment, the desired geodesic shape is watertight and/or vapor tight.

In one embodiment, anchors are attached to each desired polygonal shape, concrete is poured onto the desired polygonal shape, and once the concrete has set a crane lifts the desired polygonal shape by the anchors into place on a foundation upon which the geodesic shape rests.

In one embodiment, the desired polygonal shapes are removed after the concrete has set in place.

In one embodiment, the pre-made forms create a desired tile or panel finish that remains on the interior of the concrete dome.

In one embodiment, after the concrete has set and the geodesic shape has been created, a watershed insulating blanket is placed on top of the concrete layer, and an exterior layer is placed on top of the waterproof layer.

In one embodiment, the exterior layer is dirt, sod, or turf.

In one embodiment, vegetation is encouraged to grow on the exterior layer of dirt, sod, or turf.

The foregoing description of the embodiments of this invention has been presented for purposes of illustration and description. It is not intended to be exhaustive or to limit the invention to the precise form disclosed, and obviously, many modifications and variations are possible. Such modifications and variations that may be apparent to a person skilled in the art are intended to be included within the scope of this invention as defined by the accompanying claims.

We claim:

1. An apparatus for making a polygonal shape (14), comprising:

first through fifth or sixth struts (22, 38, 82, 94, 116, and 120), or first through fifth or sixth complete struts, comprising pairs of ten or twelve partial struts (226, 228, 240, 242, 244, 246, 248, 250, 252, 254, and 256, 258), each pair of partial struts operably coupled by a fixed interface (236), each strut or complete strut operably coupled by a strut-panel interface (146), with a first face operably coupled to a first hinge(s) and a second face operably coupled to a second hinge(s), each complete strut with a first face (232) operably coupled to a first hinge(s) (234), thus allowing a free range of motion of each strut-panel interface (146) of each pre-made form along its axis;

first through fifth or sixth pre-made forms, each first through fifth or sixth pre-made forms, comprising:

a triangular shape;

a first and a second inner edges (8, 10);

an inner face and an outer face (11, 13); and an outer edge (12);

the first pre-made form (16);

wherein the first pre-made form (16) is operably coupled along the first inner edge (8, 18) of the first pre-made form (16) to the first face (20) of the first strut (22) by the first hinge(s) (24) of the first strut (22);

the second pre-made form (26), wherein the second pre-made form (26) is operably coupled along the second inner edge (28) of the second pre-made form (26) to the second face (30) of the first strut (22), by the second hinge(s) (32) of the first strut (22);

the second strut (38), wherein the second pre-made form (26) is operably coupled along the first inner edge (34) of the second pre-made form (26) to a first face (36) of the second strut (38), by the first hinge(s) (40) of the second strut (38);

the third pre-made form (70), wherein the third pre-made form (70) is operably coupled along the second inner edge (72) of the third pre-made form (70) to a second face (74) of the second strut (38), by the second hinge(s) (76) of the second strut (38);

the third strut (82);

wherein the third pre-made form (70) is operably coupled along the first inner edge (78) of the third pre-made form (70) to a first face (80) of the third strut (82), by the first hinge(s) (84) of the third strut (82);

the fourth pre-made form (86), wherein the fourth pre-made form (86) is operably coupled along the second inner edge (88) of the fourth pre-made form (86) to a second face (90) of the third strut (82), by the second hinge(s) (92) of the third strut (82);

the fourth strut (94), wherein the fourth pre-made form (86) is operably coupled along the first inner edge (96) of the fourth pre-made form (86) to a first face (98) of the fourth strut (94), by the first hinge(s) (100) of the fourth strut (94);

the fifth pre-made form (102), wherein the fifth pre-made form (102) is operably coupled along its second inner edge (104) to second face 106) of the fourth strut (94), by the second hinge(s) (108) of the fourth strut (94);

the fifth strut (116), wherein the fifth pre-made form (102) is operably coupled along the first inner edge (112) to a first face (114) of the fifth strut (116), by the first hinge(s) (118) of the fifth strut (116), wherein either a polygonal shape comprising 5 pre-made forms is formed by operably coupling a face of the fifth strut opposite the first face (114) of the fifth strut (116) to the second inner edge (19) of the first premade form (16), or an optional sixth pre-made form (110), wherein the polygonal shape comprising the optional sixth pre-made form (110) is formed by operably coupling the face of the fifth strut opposite the first face (114) of the fifth strut (116) to the second inner edge (112) of the sixth premade form (110), by the second hinge(s) of the fifth strut (116), and by operably coupling a first face (120) of the optional sixth strut (120) to the first inner edge (43) of the optional sixth pre-made form (110), by respective first hinge(s) of the optional sixth strut (120), and by operably coupling the face of the optional sixth strut (120) opposite the first face (120) of the optional sixth strut (120), by respective second hinge(s) of the optional sixth strut (120) and the second inner edge (19) of the first pre-made form (16), wherein no first through fifth or sixth struts (22, 38, 82, 94, 116, or 120) are operably coupled to other struts, or no complete struts are operably coupled to other complete struts, wherein a free range of motion of each strut-panel interface (146) of each pre-made form along its axis aligns the axial and dihedral angles for a polygonal shape (14) comprising first through fifth or sixth struts (22, 38, 82, 94, 116, or 120), or polygonal shape (14) comprising first through fifth or sixth complete struts having been formed by pairs of ten or twelve partial struts (226, 228, 240, 242, 244, 246, 248, 250, 252, 254, and 256, 258), each pair of partial struts operably coupled by a strut-panel interface (146) to form complete struts spontaneously as the assembly progresses, and wherein the polygonal shape(s) do not require modification or reshaping of the struts or the complete struts or pre-made forms for full assembly.

2. The apparatus of claim 1, wherein all pre-made forms and all struts have been cut and shaped before on site construction.

3. The apparatus of claim 1, wherein the complete struts comprise pairs of respective partial struts, wherein each pre-made form is operably coupled along the uncoupled first inner edge of the pre-made form to a first face of the respective partial strut, by the hinge(s) of the respective pre-made form, wherein each paired partial strut is operably coupled by the strut-panel interface (146), forming a complete strut, and wherein no complete struts are operably coupled to other complete struts.

4. The apparatus of claim 1, wherein the hinges are utility hinges.

5. The apparatus of claim 1, wherein the polygonal shape has a 40 foot diameter, and weighs a maximum of 5,000 pounds.

6. The apparatus of claim 1, wherein the polygonal shape is watertight.

7. The apparatus of claim 1, further comprising anchors attached to the desired polygonal shape, for lifting a full concrete of the-polygonal shape into place.

8. The apparatus of claim 7, wherein a full concrete form is assembled onsite without recutting the struts or pre-made forms.

9. The apparatus of claim 8, wherein a tile or panel finish remains on an interior of the concrete form of the polygonal shape.

10. The apparatus of claim 1, wherein the hinges are within two inches of the outer edges (11, 13) of the pre-made forms.

11. The apparatus of claim 1, wherein after the polygonal shape is created a compression hinge is operably coupled to a common joint of the pre-made forms comprising the polygonal shape where an axial angle is formed.

12. The apparatus of claim 1, wherein one or more of the premade forms are transparent.

13. The apparatus of claim 1, wherein the polygonal shape is vapor tight.

14. A kit, comprising:

a geodesic structure made from the apparatus of claim 1, wherein the geodesic structure has a diameter of 40 feet, wherein there are 30 pre-made forms with sides measuring 5'0¾" by 5'10-⅞" by 5'0¾", 30 pre-made forms measuring 5'10-⅝" by 5'10-⅞" by 5'10-⅝", 60 pre-made forms measuring 5'10-⅝" by 6'3⅛" by 5'11-⅝", 30 pre-made forms measuring 6'3⅛" by 6'6" by 6'3⅛", and 10 pre-made forms measuring 6'6 by 6'6 by 6'6.

15. The kit of claim 14, wherein the geodesic structure has a frequency 4 and a 40 foot diameter, and polygonal shape weighs a maximum of 5,000 pounds.

* * * * *